US007287530B1

(12) United States Patent
Stuart

(10) Patent No.: US 7,287,530 B1
(45) Date of Patent: Oct. 30, 2007

(54) TOBACCO HOOKAH

(75) Inventor: Paul Stuart, 1056 Kalai Pl., Pearl City, HI (US) 96782

(73) Assignee: Paul Stuart, Makaha, HI (US)

( * ) Notice: Subject to any disclaimer, the term of this patent is extended or adjusted under 35 U.S.C. 154(b) by 770 days.

(21) Appl. No.: 10/810,734

(22) Filed: Mar. 27, 2004

Related U.S. Application Data

(60) Provisional application No. 60/459,883, filed on Apr. 2, 2003.

(51) Int. Cl.
*A02F 1/14* (2006.01)

(52) U.S. Cl. ..... 131/173

(58) Field of Classification Search ..... 131/173
See application file for complete search history.

(56) References Cited

U.S. PATENT DOCUMENTS

| | | | | |
|---|---|---|---|---|
| 1,513,147 | A | 10/1924 | Zahariadis | |
| 3,863,646 | A | 2/1975 | Kahler | |
| 3,872,872 | A | 3/1975 | Kahler | |
| 3,889,690 | A | 6/1975 | Guamieri | |
| 3,918,464 | A | 11/1975 | Kolodziej | |
| 4,116,204 | A | 9/1978 | Kline | |
| 4,133,318 | A | 1/1979 | Gross | |
| 4,140,138 | A | 2/1979 | Keller | |
| 4,216,785 | A | 8/1980 | Erickson et al. | |
| 4,253,475 | A * | 3/1981 | Schreiber et al. | 131/173 |
| 4,648,410 | A | 3/1987 | Seroussi | |
| 2002/0074006 | A1 * | 6/2002 | Gunn | 131/173 |

* cited by examiner

*Primary Examiner*—Eric Hug
*Assistant Examiner*—Michael J. Felton

(57) ABSTRACT

The present invention is an improved tobacco hookah or water pipe, comprising a water reservoir, a smoke and vapor collection chamber, and a flexible hose through which smoke and vapor may be inhaled. In this improved hookah, water used to filter and cool smoke and vapor also serves to draw smoke and vapor into a smoke and vapor collection chamber using a hydraulic pressure gradient, also known as head, relieving an operator of the necessity of personally creating a vacuum or negative pressure needed to draw smoke and vapor into a smoke and vapor collection chamber, and capable of attaining substantially greater vacuum or negative pressure than is possible with ordinary inhalation. In addition this improved hookah permits an operator to control and vary the vacuum or negative pressure so created, so controlling the rate at which smoke and vapor is drawn into the hookah, and thus the rate and temperature of tobacco combustion. Following collection of a suitable quantity of smoke and vapor, water then serves to flush smoke and vapor from a smoke and vapor collection chamber, dispensing smoke and vapor for inhalation and relieving a smoker of the necessity of personally creating a vacuum or negative pressure to inhale a desired quantity of smoke and vapor, simultaneously preventing any undesired egress of smoke and vapor, and providing an operator with the ability to control the rate at which smoke and vapor is dispensed. This improved hookah provides for the collection and dispensing of a predetermined quantity of smoke and vapor which may be set and changed by an operator, allows for the repeatable collection and dispensing of substantially similar quantities of smoke in operation, and may be operated with any of a plurality of suitable smoke and vapor production devices.

10 Claims, 12 Drawing Sheets

TOBACCO HOOKAH

CROSS-REFERENCE TO RELATED APPLICATIONS

This application claims the benefit of PPA Ser. No. 60/459,883, filed 2003 Apr. 2, 2003 by the present inventor.

FEDERALLY SPONSORED RESEARCH

Not applicable.

SEQUENCE LISTING OR PROGRAM

Not applicable.

BACKGROUND OF THE INVENTION

1. Field of Invention

This invention relates generally to the field of hookahs and water pipes, specifically to hookahs and water pipes in which water used to filter and cool smoke and vapor also serves to draw smoke and vapor into a smoke and vapor collection chamber using a hydraulic pressure gradient, also known as head, and to flush smoke and vapor from a smoke and vapor collection chamber, dispensing smoke and vapor for inhalation.

2. Background of the Invention

The hookah or water pipe has been used for centuries to smoke both plain and flavored tobaccos, mixtures of various aromatic herbs and spices, or mixtures of both. Typically a hookah has of a bowl in which tobacco is placed mounted on top of a reservoir structure, the interior of which is partially filled with water. Extending downward from the bowl into the reservoir is a tubular hollow stem, with its lowermost extremity immersed in the water. The interior portion of the reservoir structure above the level of the water forms a chamber into which smoke may be collected. One or more flexible hoses extend outward from the smoke collection portion of the interior of the reservoir. An example of such a typical hookah is shown by the design of U.S. Pat. No. Des. 403,106, Tobacco Hookah, Barnes.

Inhaling through a flexible hose, a smoker causes smoke to be drawn from the bowl down the stem, passing the smoke through the water in the lower portion of the reservoir. Passing upwards through the water in the form of bubbles, smoke gradually fills the smoke collection portion of the reservoir, and when sufficient smoke has been collected passes on through the flexible hose to the smoker.

By drawing the smoke through a water reservoir, the smoke is filtered and cooled, making the smoking experience even more pleasant and enjoyable. Because the requirement for a water reservoir results in increased size and weight, use of a flexible hose through which smoke may be inhaled provides a simple and easy way to use the hookah, and to share this enjoyable smoking experience among a number of smokers.

This basic functionality is shared by virtually all traditional hookahs, which generally differ only in size, shape, and number of hoses, although the means used to burn the tobacco may also differ. Some use a lighted coal placed in or above the bowl with the tobacco to provide a heat source for burning the tobacco. Others may require an ignition source such as a match to be placed near the bowl to begin burning the tobacco. However all traditional hookahs use combustion as the method of producing smoke, thus also producing all the undesirable combustion by-products in the smoke. Use of water to filter and cool the smoke significantly reduces many of the undesirable smoke components, but some, such as carbon monoxide, cannot be removed in this manner.

For centuries combustion was the only technology available for production of smoke. However, the widespread availability of electric power has allowed development of a variety of ingenious alternatives to combustion for use by smokers. These typically generate a sufficient amount of heat to vaporize volatile aromatic components of the tobacco without actually burning the tobacco, in this way avoiding production of undesirable combustion by-products such as carbon monoxide present in smoke. Examples of these include the devices U.S. Pat. No. 5,819,756, Smoking or Inhalation Device, Mielordt; U.S. Pat. No. 2,104,266, Means for the Production and Inhalation of Tobacco Fumes, McCormick; and U.S. Pat. No. 5,285,798, Tobacco smoking article with electrochemical heat source, Banneriee et al. However, despite the existence of these and other technologies, all hookahs and the vast majority of smoking appliances still rely on the use of combustion as the means to produce smoke and vapor for inhalation, and make no provision for the use of any alternate technology.

Irrespective of the means used by a given hookah to produce smoke, the method of smoking is the same. The smoker inhales from a flexible hose, drawing smoke from the bowl down through the stem to bubble up from the lowermost extremity of the stem immersed in water, filtering and cooling the smoke. The filtered, cooled smoke gradually collects in the interior portion of the hookah, from which it is drawn by inhalation through a flexible hose.

Unfortunately until sufficient smoke has been collected in the interior of the hookah the smoker experiences only the effort of sucking air through the hookah. In a large hookah with a large interior collection chamber, this may require several minutes of effort. Likewise, after the interior portion of the hookah has filled with collected smoke, there is no provision to flush the smoke from the chamber, so a continuous effort must be exerted to enjoy the smoking experience. And unfortunately the collected smoke can become "stale" and unpleasant in taste if not inhaled soon enough, resulting in reduced enjoyment of the smoking experience.

In all traditional hookahs and water pipes a human smoker inhales from a flexible hose or mouthpiece to create the vacuum or negative pressure required to draw smoke through the filtering and cooling water into the interior of the hookah or water pipe. This limits the maximum vacuum or negative pressure that can be created to that which can be produced by normal human lung power. The vacuum or negative pressure in turn influences the combustion rate of the tobacco. The flavors of different types of tobaccos can be influenced by the combustion rate. Some are best when burned slowly at relatively low temperatures, others when burned quickly at relatively higher temperatures. However, the limited ability of human lung power to produce a vacuum or negative pressure also limits the maximum combustion rate that can be achieved in a traditional hookah or water pipe.

Furthermore, the dependence upon human lung power also limits the depth at which the lowermost extremity of the stem can be immersed, thus limiting the amount of water through which the smoke can be passed to be filtered and cooled. If the depth at which the lowermost extremity of the stem is immersed is too great, normal human lung power cannot attain a sufficient vacuum or negative pressure to draw smoke from the bowl into the interior of the hookah.

This in turn limits the amount of filtering and cooling that can be achieved in a traditional hookah or water pipe.

Nonetheless, the combination of ease-of-use and smoking pleasure provided by the hookah have not been excelled by any subsequent smoking technology.

In recent times a number of water-pipe alternatives to the hookah have been developed that address the issue of flushing smoke from chamber into which smoke has been collected. Generally known as bongs, such devices generally consist of a tubular body containing a quantity of water in the lowermost portion of its interior, with a stem-and-bowl combination protruding from the body above the level of the water, and with the lowermost portion of the stem immersed in water inside the tubular body.

A small hole in the body of the bong above the water line is covered with a finger or thumb while inhaling, drawing smoke through the filtering and cooling water and allowing the smoke to fill the interior portion of the tubular body. When uncovered, this hole allows the collected smoke to be thoroughly flushed out of the tubular body with a minimum of inhalation effort. However the inhalation effort required to fill the chamber with smoke can still be substantial. Typical of such designs are: U.S. Pat. No. 3,868,646, Smoking Device, Kahler; U.S. Pat. No. 4,111,213, Smoking Pipe, Shanto et al.; U.S. Pat. No. 4,216,785, Water Pipe or Bong, Erickson et al.; U.S. Pat. No. 4,148,326, Automatic Loading Bong, Harbaugh; Interesting variations on the typical bong design are illustrated by the designs of U.S. Pat. No. 4,116,204, Collapsible Telescopic Water Pipe, Kline; and U.S. Pat. No. 4,111,214, Water Pipe, Flesher.

An additional approach to the problem of flushing smoke from the smoke collection chamber of a bong is provided by the design of U.S. Pat. No. 4,253,475, Water Pipes or Bongs, Ronald J. and Batya R. G. Schreiber. This device uses the water present in the bong to assist in flushing the smoke from the smoke collection chamber, however still relying on human lung power to create the requisite vacuum or negative pressure. To protect the smoker from a mouthful of foul-tasting water an intricate water-trap mechanism is provided. In addition, the combustion bowl must be sealed off from the water with a valve when using the cooling water to flush smoke from the bong. While it is ingenious, the inhalation effort required to fill the collection chamber remains, and use of this device may require more effort than many smokers are willing to invest. In addition, the time required for water to drain from the water trap mechanism and refill the filtering reservoir may limit the appeal of this device.

Like the hookah, all of these devices share the traditional, intuitive use of a bowl for the combustion of tobacco to produce smoke and a separate mouthpiece for the inhalation of smoke from a smoke collection chamber, connected to the bowl by some means which allows the smoke to be passed through a water reservoir to be filtered and cooled. Also like the hookah, all of these devices require the smoker to exert an inhalation effort, in some cases substantial, to fill a collection chamber with smoke prior to actual inhalation of smoke. Although they do address the problem of flushing collected smoke from a smoke collection chamber, lacking a flexible hose, they all lack the relaxed and enjoyable appeal of the smoking experience provided by the hookah. And the reliance on human lung power limits both the maximum vacuum or negative pressure that can be attained and the combustion rate of the tobacco.

An attempt to simultaneously address the problems of inhalation effort and flushing of the smoke collection chamber is presented by patent application Pub. No. U.S. 2002/0074006 A1, Telescoping Water Pipe, Gunn. However, this device is not truly a water pipe in the traditional sense, as the water present in this device provides little or no filtering and cooling of the smoke, and could be replaced by a fixed piston with little or no loss of functionality. A innovative, non-traditional, and somewhat counterintuitive use of the same orifice for both production and collection of smoke and the inhalation of smoke, requiring the bowl assembly to be removed from the device prior to inhalation, may be confusing to some smokers. Lacking the hookah hose, inhalation from this device may also require a physical effort and coordination that some smokers may consider excessive.

What is needed to overcome the various disadvantages evident in the prior art is a hookah or water pipe that allows for the use of either traditional combustion, modern electronic, or other means for the production of smoke and vapor, uses water to filter and cool the smoke and vapor produced, eliminates the inhalation effort required by a traditional hookah or water pipe, provides a means for flushing the collected smoke and vapor from the interior portion of the hookah, and makes traditional, intuitive use of a mouthpiece for inhalation and a separate bowl or other suitable structure for the placement of tobacco from which smoke and vapor can be produced. Such a device would combine the advantages of the prior art while eliminating their various respective disadvantages. As will be seen, this improved hookah achieves these objects and advantages with a minimum of functioning parts in a new, unobvious, and useful combination.

Objects and Advantages

The present invention relates generally to the field of hookahs and water pipes, specifically to hookahs and water pipes in which water used to filter and cool smoke and vapor also serves to draw a quantity of smoke and vapor into a smoke and vapor collection chamber using a hydraulic pressure gradient or head, and to flush smoke and vapor from a smoke and vapor collection chamber through a flexible hose, dispensing smoke and vapor for inhalation.

Accordingly, several objects and advantages of this improved hookah or water pipe are:

(a) to provide a hookah or water pipe which allows for use of any of a plurality of smoke and vapor production devices to produce of a desired quantity of smoke and vapor for inhalation;

(b) to provide a hookah or water pipe capable of using a substantially greater quantity of water than is present in a traditional hookah or water pipe, thus providing greater filtering and cooling capacity;

(c) to provide a hookah or water pipe capable of passing smoke and vapor in the form of bubbles through a substantially greater quantity of water than is present in a traditional hookah or water pipe, thus providing greater filtering and cooling of the smoke and vapor;

(d) to provide an ability to collect a desired quantity of smoke and vapor for inhalation without the necessity or strain of personally creating the vacuum or negative pressure required within the interior of a conventional hookah or water pipe in order to draw smoke and vapor from a smoke and vapor production device into the interior of a conventional hookah or water pipe;

(e) to provide an ability to create a vacuum or negative pressure that can be substantially greater than the vacuum or negative pressure attainable by normal human inhalation, thus also allowing a combustion rate and draw rate substantially greater than can be achieved with a traditional hookah or water pipe;

(f) to provide an ability to flush or expel a desired quantity of smoke and vapor so collected for inhalation without the necessity or strain of personally creating the vacuum or negative pressure required within the interior of a conventional hookah or water pipe in order to draw smoke and vapor from the interior of the hookah or water pipe through a flexible hose for inhalation; Further objects and advantages of this improved hookah or water pipe are:

(g) to provide an ability to use the water present to filter and cool smoke and vapor to also serve to draw a desired quantity of smoke and vapor from a smoke and vapor production device into the interior of a hookah or water pipe;

(h) to provide an ability to increase, decrease, and otherwise control the vacuum or negative pressure used to draw smoke and vapor into the interior of a hookah or water pipe so as to also control the combustion rate of the tobacco, thus providing greater control and flexibility in burning the tobacco than can be achieved with a traditional hookah or water pipe;

(i) to provide an ability to use the water present to filter and cool smoke and vapor to also serve to flush, expel, or dispense a desired quantity of smoke and vapor from within the interior of the hookah or water pipe through a flexible hose for inhalation by a smoker;

(j) to provide an ability to use the water present to filter and cool smoke and vapor to also serve to prevent undesired outward flow of smoke and vapor through the hookah smoke and vapor stem member and smoke and vapor production device when flushing, expelling, or dispensing a desired quantity of smoke and vapor from the interior of the hookah or water pipe;

(k) to provide a hookah or water pipe which can collect a predetermined quantity of smoke and vapor within its interior;

(l) to provide a hookah or water pipe with an ability to set a predetermined quantity of smoke and vapor to be collected within its interior;

(m) to provide a hookah or water pipe in which a predetermined quantity of smoke and vapor to be collected within its interior can be changed during operation;

(n) to provide a hookah or water pipe which can dispense a measured quantity of smoke and vapor for inhalation;

(o) to provide a hookah or water pipe with an ability to control and vary the rate at which a quantity of smoke and vapor is dispensed for inhalation;

(p) to provide a hookah or water pipe which can repeatedly and reliably collect and dispense substantially similar predetermined quantities of smoke and vapor for inhalation;

Other objects and advantages of this improved hookah are to provide a hookah or water pipe that is simple and enjoyable to use, makes efficient and economical use of tobacco, and is inexpensive to manufacture. Still further objects and advantages will become apparent from a consideration of the ensuing description and drawings.

SUMMARY

The present invention is an improved tobacco hookah or water pipe. This improved hookah comprises a water reservoir, a smoke and vapor collection chamber, and a flexible hose through which smoke and vapor may be inhaled. In this improved hookah, water used to filter and cool smoke and vapor also serves to draw smoke and vapor into a smoke and vapor collection chamber using a hydraulic pressure gradient, also known as head, relieving an operator of the necessity of personally creating a vacuum or negative pressure needed to draw smoke and vapor into a smoke and vapor collection chamber, and capable of attaining substantially greater vacuum or negative pressure than is possible with ordinary inhalation. In addition this improved hookah permits an operator to control and vary the vacuum or negative pressure so created, so controlling the rate at which smoke and vapor is drawn into the hookah, and thus the rate and temperature of tobacco combustion. Following collection of a suitable quantity of smoke and vapor, water then serves to flush smoke and vapor from a smoke and vapor collection chamber, dispensing smoke and vapor for inhalation and relieving a smoker of the necessity of personally creating a vacuum or negative pressure to inhale a desired quantity of smoke and vapor, simultaneously preventing any undesired egress of smoke and vapor, and providing an operator with the ability to control the rate at which smoke and vapor is dispensed. This improved hookah provides for the collection and dispensing of a predetermined quantity of smoke and vapor which may be set and changed by an operator, allows for the repeatable collection and dispensing of substantially similar quantities of smoke in operation, and may be operated with any of a plurality of suitable smoke and vapor production devices.

DRAWINGS—FIGURES

FIG. **5*a*** is a longitudinal cross-section of a preferred embodiment showing a complete improved hookah assembly, filled with water, ready for operation, illustrating a difference in a predetermined smoke and vapor capacity selected by an operator, as will be described further herein.

Figure 6:
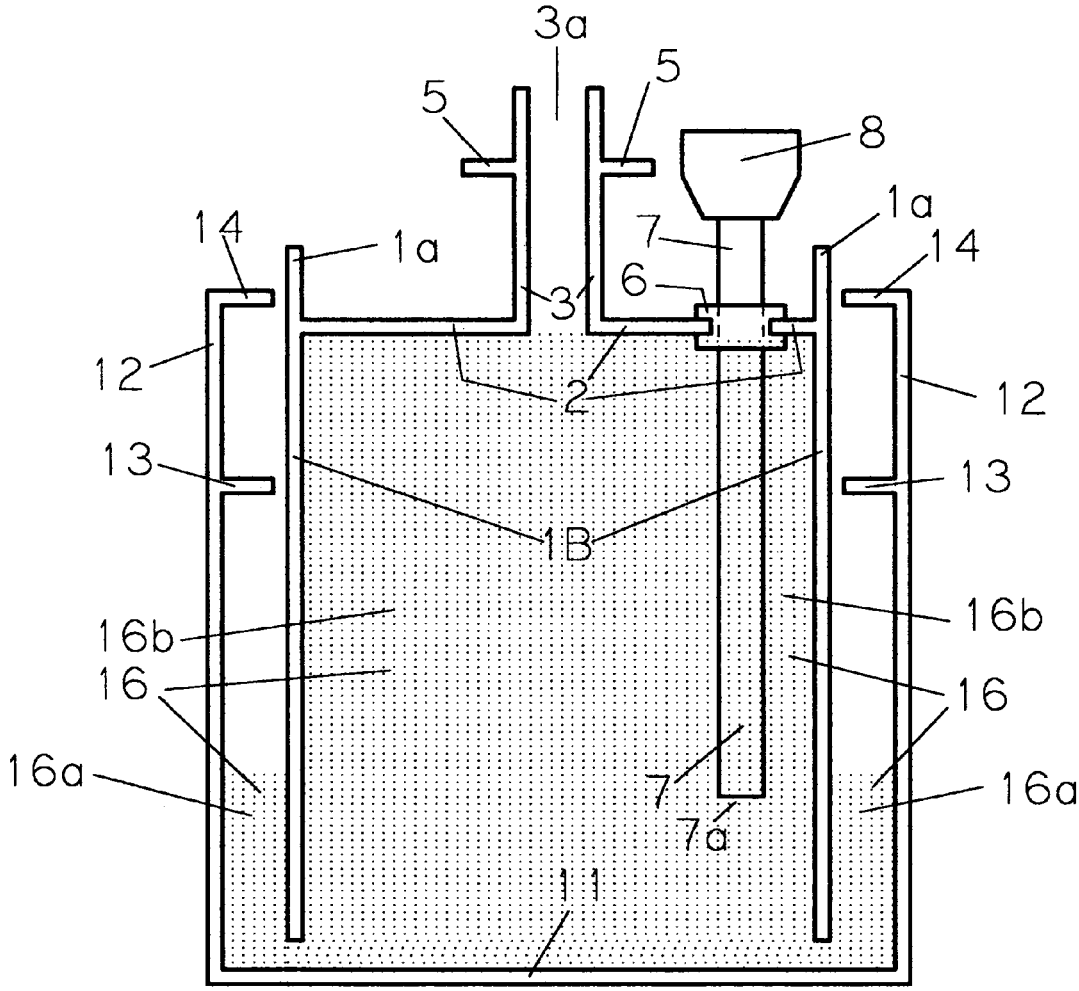

FIG. 6 is a longitudinal cross-section of a preferred embodiment showing a complete improved hookah assembly in operation, at a point when insufficient head exists to begin drawing smoke and vapor into a smoke and vapor collection chamber, as will be described further herein.

Figure 7:
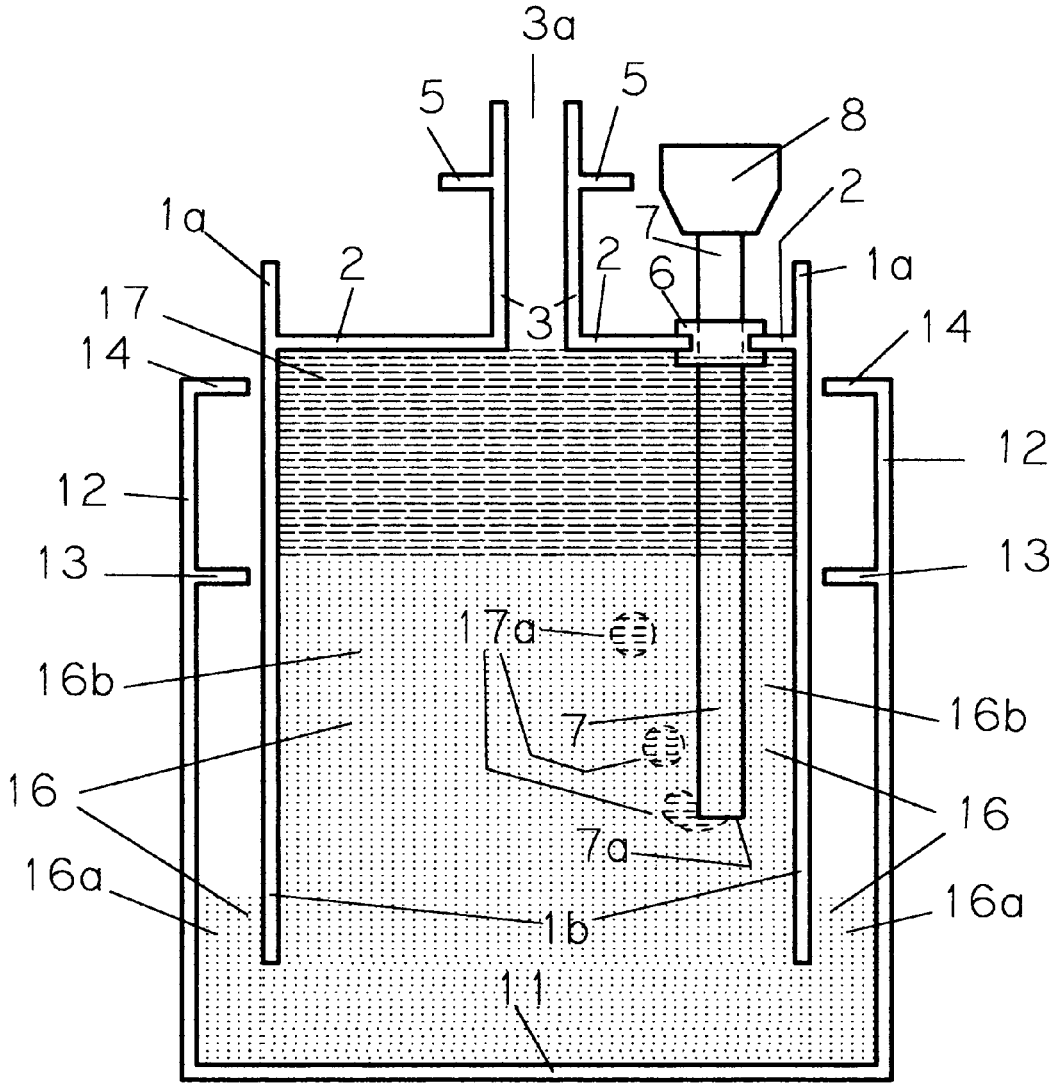

FIG. 7 is a longitudinal cross-section of a preferred embodiment showing a complete improved hookah assembly in operation, with an amount of smoke and vapor present in the smoke and vapor collection chamber, at a point when sufficient head exists to draw additional smoke and vapor into the smoke and vapor collection chamber, as will be described further herein.

Figure 8:
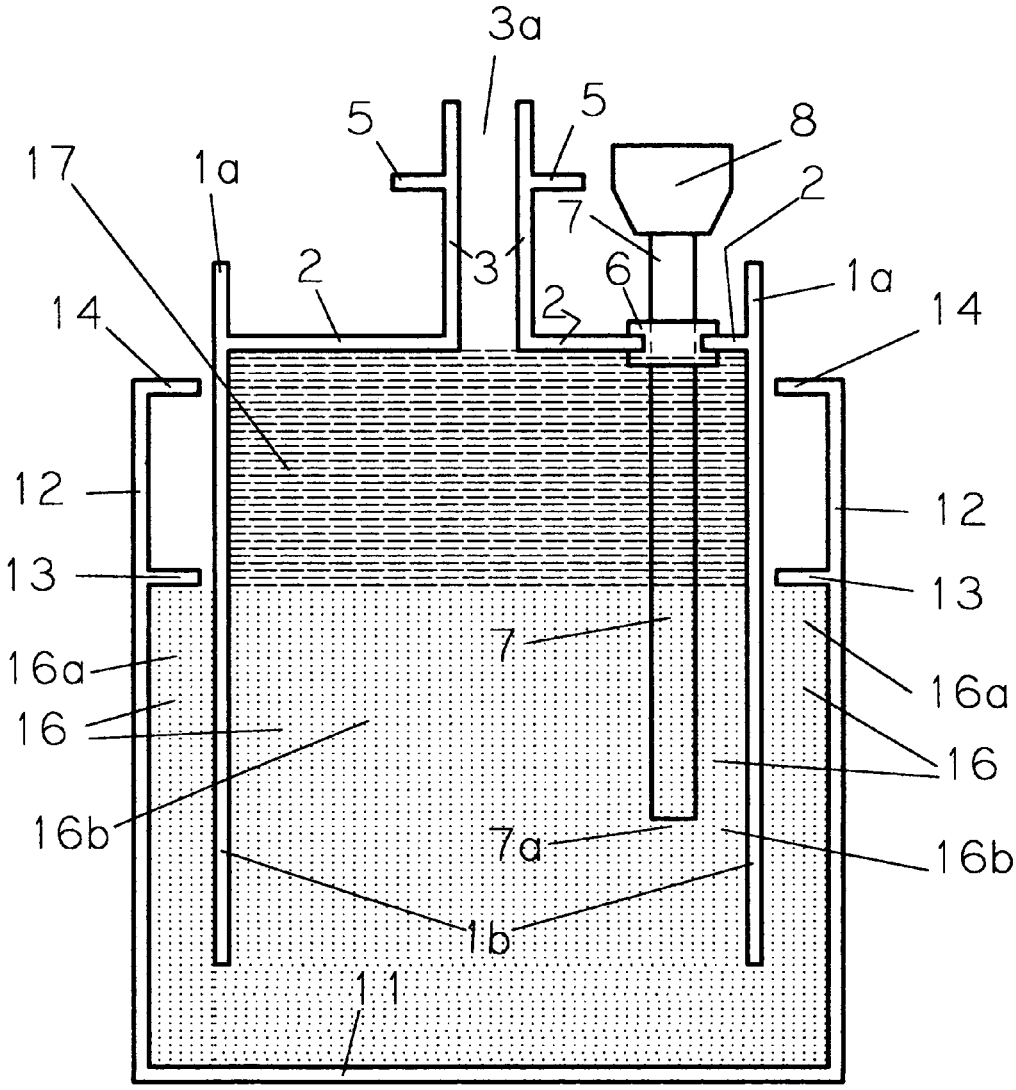

FIG. 8 is a longitudinal cross-section of a preferred embodiment showing a complete improved hookah assembly in operation, ready to dispense smoke and vapor, as will be described further herein.

Figure 9:
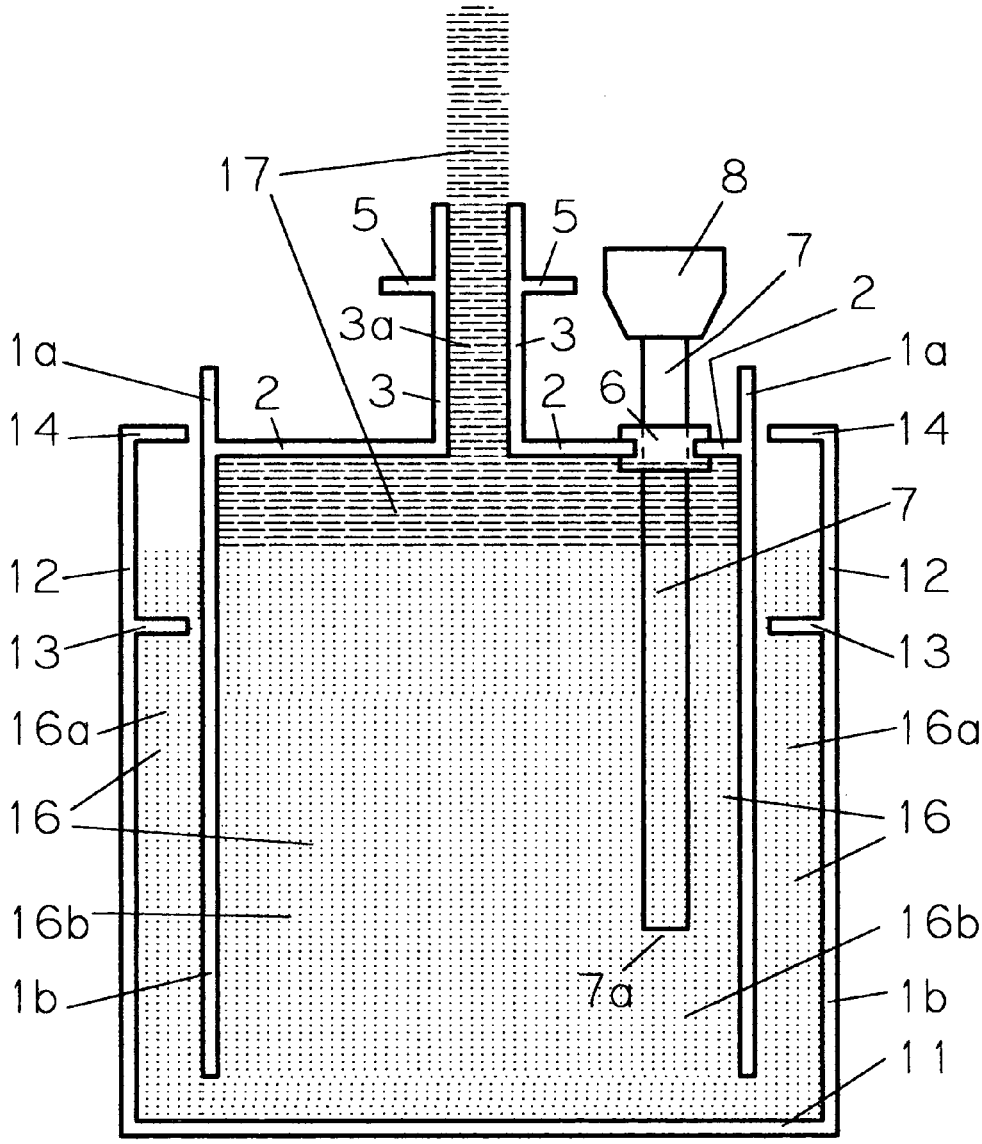

FIG. 9 is a longitudinal cross-section of a preferred embodiment showing a complete improved hookah assembly in operation, dispensing smoke, as will be described further herein.

Figure 1:
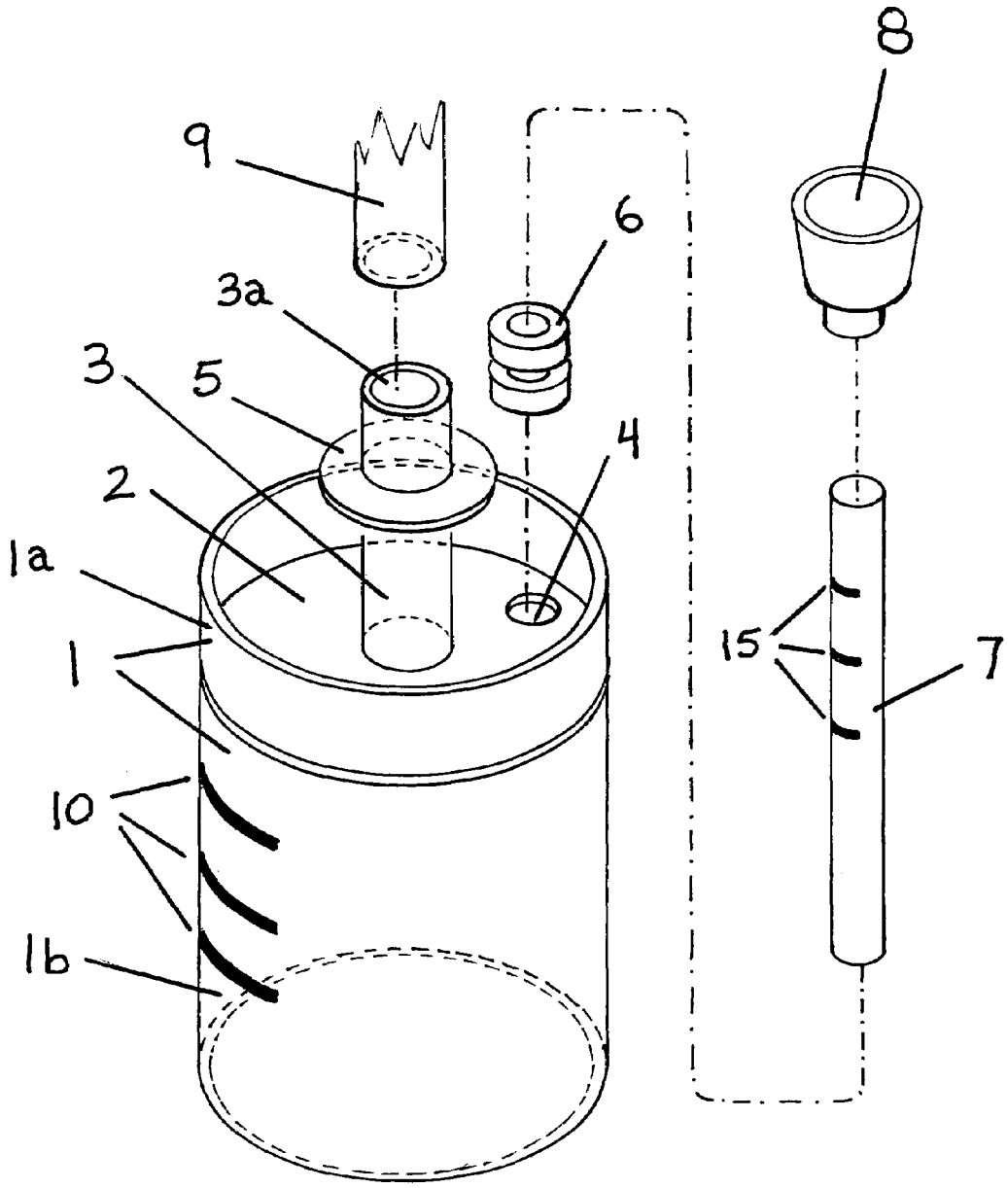
FIG. 1 shows a perspective view of a preferred embodiment of an improved hookah smoke and vapor collection chamber.
Figure 2:
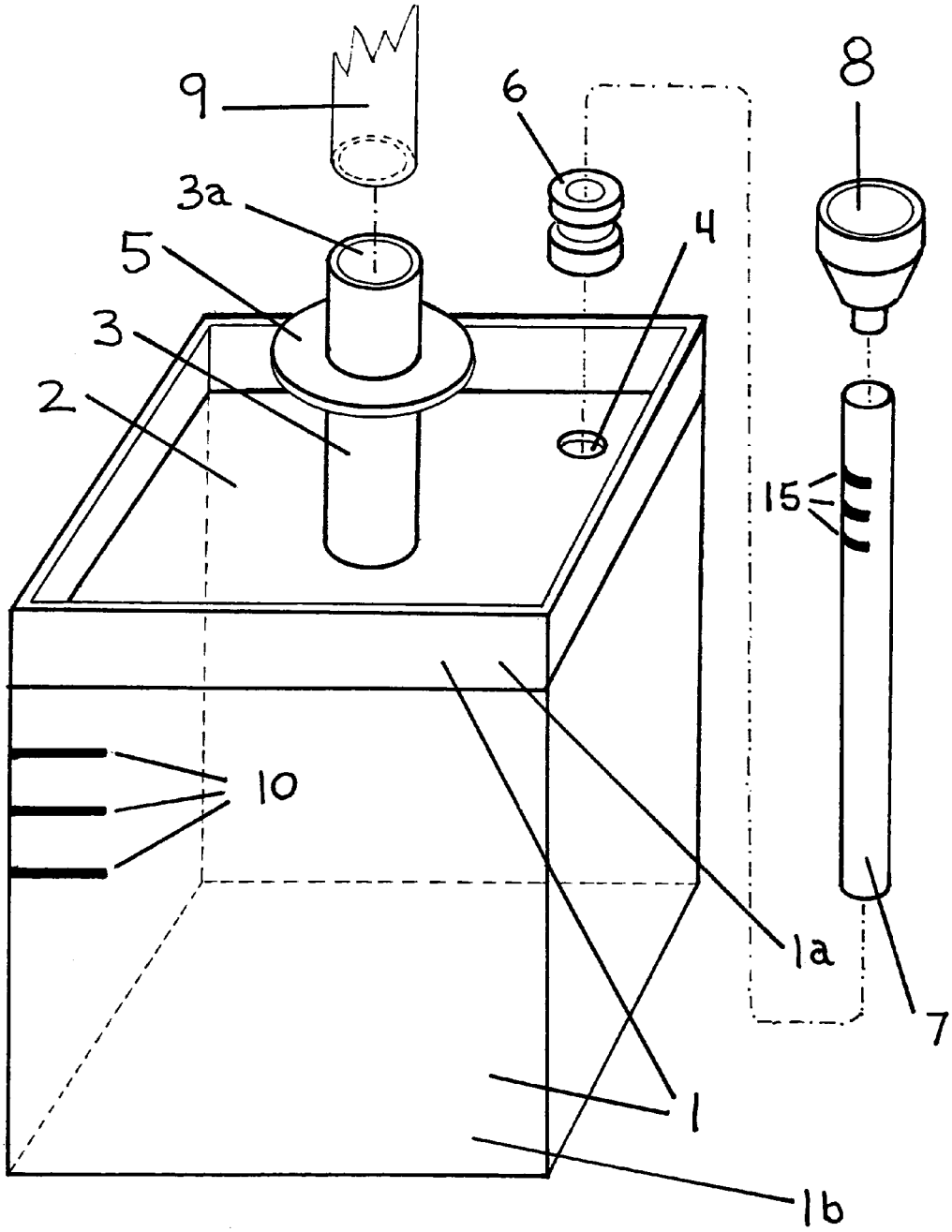
FIG. 2 shows a perspective view of an alternate embodiment of an improved hookah smoke and vapor collection chamber.
Figure 10:
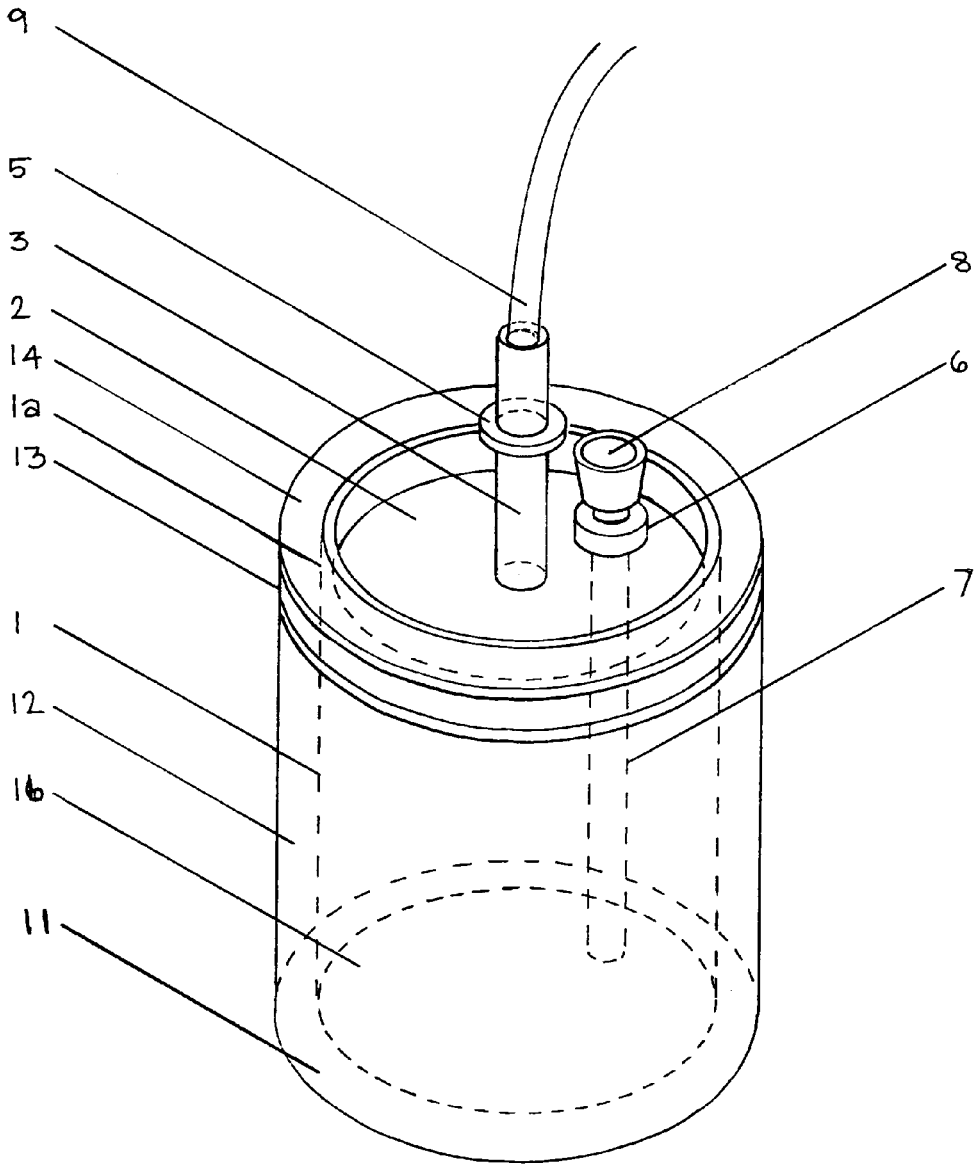

FIG. 10 is a perspective view of a preferred embodiment of a complete hookah assembly, showing a smoke collection chamber (FIG. 1) with attached hose, installed into a water reservoir (FIG. 2).

Figure 11:
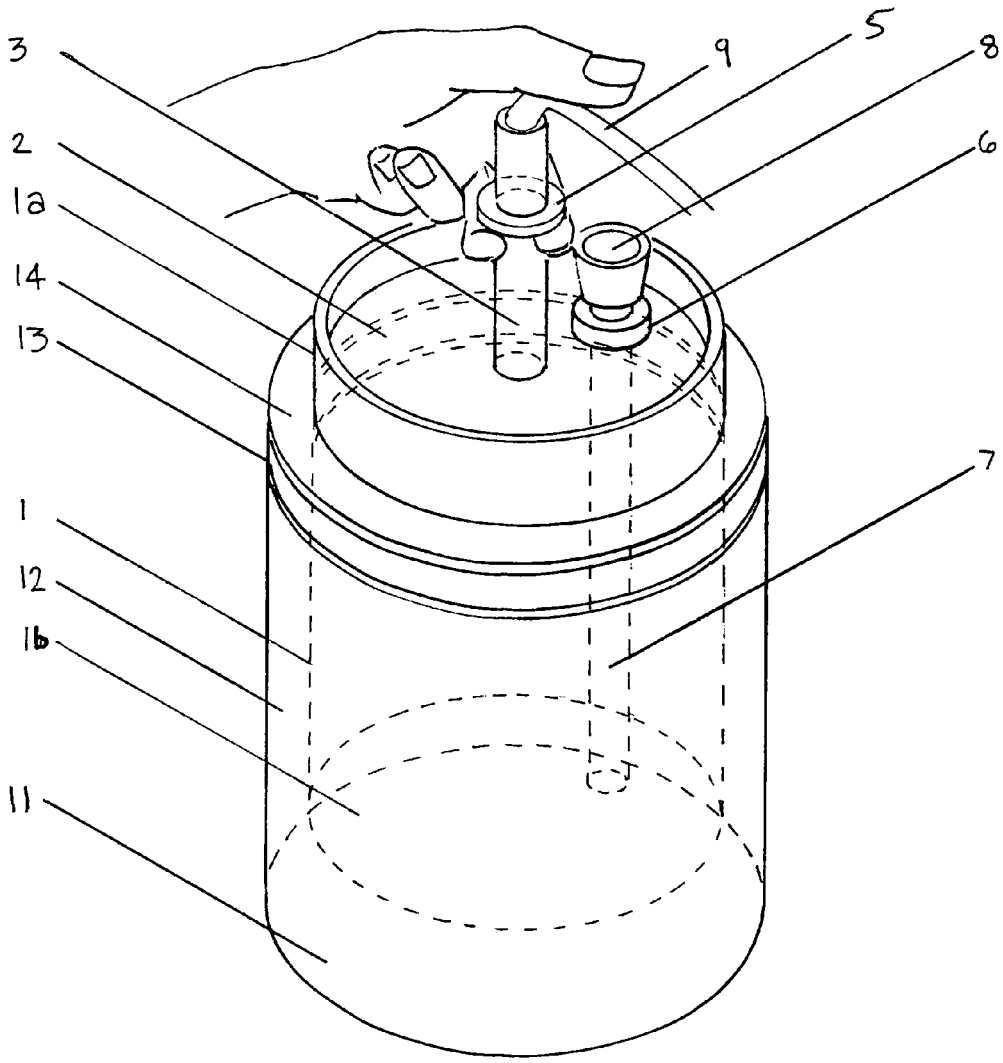

FIG. 11 is a perspective view of a preferred embodiment of a complete improved hookah assembly showing an operator demonstrating its use, as described further herein.

DRAWINGS—REFERENCE NUMERALS

| | |
|---|---|
| 1 | chamber body |
| 1a | upper chamber body |
| 1b | lower chamber body |
| 2 | chamber top |
| 3 | smoke and vapor exhaust stem |
| 3a | smoke and vapor exhaust passage |
| 4 | hole in chamber top 2 |
| 5 | head production ring |
| 6 | grommet |
| 7 | tubular hollow stem |
| 7a | lowermost extent of tubular hollow stem |
| 8 | smoke and vapor production device |
| 9 | flexible hose |
| 10 | volume graduation marks |
| 11 | reservoir base |
| 12 | reservoir body |
| 13 | chamber guide |
| 14 | reservoir top |
| 15 | capacity graduation marks |
| 16 | water |
| 16a | reservoir water level |
| 16b | chamber water level |
| 17 | smoke and vapor |

Figure 3:
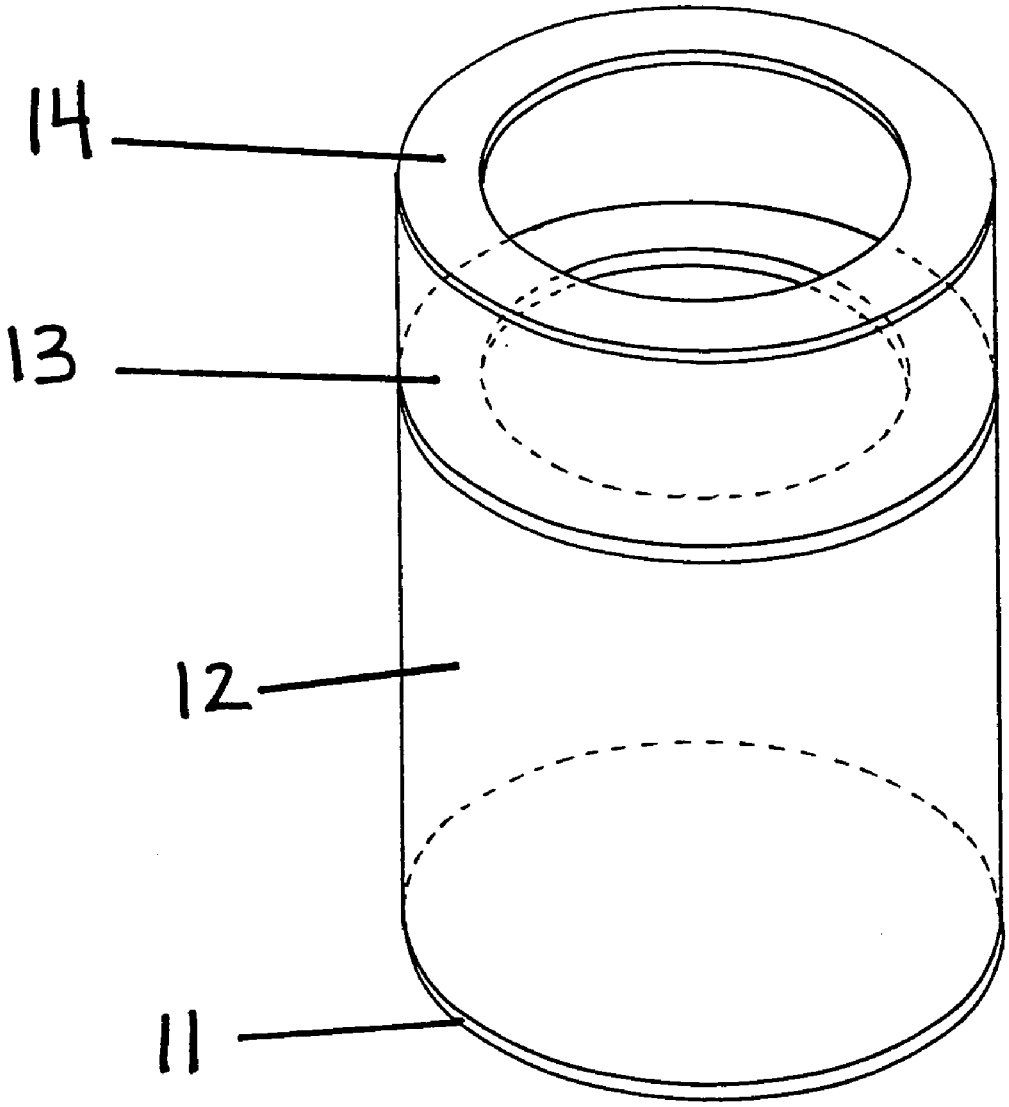
FIG. 3 shows a perspective view of a preferred embodiment of an improved hookah water reservoir.

DETAILED DESCRIPTION—FIGS. 1, 3, and 10—PREFERRED EMBODIMENT

A preferred embodiment of an improved tobacco hookah is illustrated by FIG. 1, FIG. 3, and FIG. 10.

FIG. 1 is a perspective view of a preferred embodiment of a smoke and vapor collection chamber, comprising a chamber body 1, a chamber top 2, a tubular hollow smoke and vapor exhaust stem 3 to an uppermost extent of which a flexible hose 9 may be demountably attached, a head production ring 5, a grommet 6, and a tubular hollow stem 7 to an uppermost extent of which a demountable smoke and vapor production device 8 such as a bowl for containing and burning a suitable quantity of tobacco may be rigidly attached.

Chamber body 1 comprises a substantially upright circular cylindrical upper chamber body 1*a* having an innermost and an outermost surface, a substantially upright circular cylindrical lower chamber body 1*b* having an innermost and an outermost surface, substantially similar in innermost and outermost dimension to upper chamber body 1*a*, and a chamber top 2.

Chamber top 2 comprises a substantially horizontal member having an uppermost and a lowermost surface, of sufficient horizontal dimension to extend across chamber body 1 and rigidly attached thereto in such manner as to form a substantially airtight seal therewith, a tubular hollow smoke and vapor exhaust stem 3, a smoke and vapor exhaust passage 3*a* through an uppermost and a lowermost surface of chamber top 2 and extending through an interior portion of smoke and vapor exhaust stem 3 to an uppermost extent thereof, a head production ring 5, and a hole 4 penetrating from an uppermost surface of chamber top 2 to a lowermost surface of chamber top 2 and so positioned as to be between an outermost extent of exhaust stem 3 and an innermost surface of chamber body 1.

Upper chamber body 1*a* comprises that portion of chamber body 1 extending upwards from an uppermost surface of chamber top 2 and rigidly attached thereto in such manner as to form a substantially airtight and watertight seal therewith, positioned and dimensioned so as to prevent water from spilling onto an uppermost surface of chamber top 2 during operation.

Lower chamber body 1*b* comprises that portion of chamber body 1 extending downwards from a lowermost surface of chamber top 2 and rigidly attached thereto in such manner as to form a substantially airtight and watertight seal therewith. Open at a lowermost extent to readily allow entry and egress of water, a portion of an interior of lower chamber body 1*b* forms a chamber into which smoke and vapor may be collected and from which smoke and vapor may be dispensed during operation.

Volume graduation marks 10 placed at appropriate intervals on a surface of lower chamber body 1*b* allow measurement of a quantity of smoke and vapor collected or dispensed during operation.

Exhaust stem 3 comprises a tubular hollow circular cylinder with an innermost and an outermost surface, its lowermost extent rigidly attached to an uppermost surface of chamber top 2 in such manner as to form a substantially airtight seal therewith, substantially perpendicular thereto and extending upwards therefrom, having within its innermost surface an interior portion forming a passage 3*a* opening through an uppermost surface of chamber top 2 and a lowermost surface of chamber top 2 into an interior portion of lower chamber body 1*b* through which collected smoke and vapor may be dispensed. Exhaust stem 3 is of a sufficient inner dimension to allow smoke and vapor to flow readily through passage 3*a*, and of sufficient outer dimension to enable formation of a substantially airtight seal when covered at an uppermost extent thereof with an operator's thumb.

Flexible hose 9, of sufficient interior dimension to allow smoke and vapor to flow readily therethrough, of sufficient exterior dimension to form a snug, substantially airtight seal with an innermost surface of exhaust stem 3, may be inserted into an uppermost extent of exhaust stem 3 for the convenient dispensing of smoke and vapor.

Head production ring 5 comprises a substantially horizontal circular annulus having an uppermost and a lowermost surface and an innermost and an outermost diameter, substantially similar in innermost diameter to an outermost surface of exhaust stem 3 and rigidly attached thereto, of sufficient outermost diameter for a secure grip during operation, providing an ability to raise and lower the smoke and vapor collection chamber during operation. Head production ring 5 is so dimensioned and positioned as to ensure an operator may completely cover an uppermost extent of exhaust stem 3 with a thumb to form a substantially airtight seal thereof during operation, or to fold and kink a suitably inserted flexible hose 9 against an uppermost extent of exhaust stem 3 during operation, providing an ability to form a substantially airtight seal thereof, and simultaneously providing a secure grip for the production of head during operation.

Grommet 6 of rubber or other flexible, heat-resistant material is demountably inserted into hole 4 in chamber top 2.

Tubular hollow stem 7 having at its uppermost extent a demountable rigidly attached smoke and vapor production device 8 such as a bowl for containing and burning a suitable quantity of tobacco is demountably thrust through grommet 6, extending for a portion of its length below a lowermost surface of chamber top 2 into a portion of an interior of lower chamber body 1*b*, having a lowermost extent 7*a* so positioned as to be between a lowermost surface of chamber top 2 and a lowermost extent of lower chamber body 1*b*, extending also for a portion of its length above an uppermost surface of chamber top 2.

Capacity graduation marks 15 placed at appropriate intervals on a surface of tubular hollow stem 7 allow selection of a predetermined smoke and vapor volume capacity during operation, as described further herein.

Hole 4, grommet 6, and tubular hollow stem 7 are of dimensions such that a substantially airtight seal is formed between chamber top 2 and grommet 6, and between grommet 6 and tubular hollow stem 7.

FIG. 3 is a perspective view of a preferred embodiment of a water reservoir, comprising a reservoir base 11, a reservoir body 12, a smoke and vapor collection chamber guide 13, and a reservoir top 14. Reservoir body 12, chamber guide 13, and reservoir top 14 have sufficient inner dimensions to readily allow easy insertion, removal, and vertical motion of a demountably installable smoke and vapor collection chamber (FIG. 1), simultaneously limiting horizontal motion of suitably installed a smoke and vapor collection chamber.

Reservoir body 12 comprises a substantially upright circular cylinder having an innermost and an outermost surface.

Reservoir base 11 comprises a substantially horizontal disk having an uppermost and a lowermost surface, substantially similar in outermost dimension to reservoir body 12, located at a lowermost extent of reservoir body 12 and having an uppermost surface rigidly attached thereto in such manner as to form a substantially watertight seal therewith, and is suitable to enable stable placement of a water reservoir on a flat, level surface such as a table.

A portion of an interior of a chamber formed by reservoir base 11 and reservoir body 12 is capable of containing a sufficient quantity of water to enable hookah operation as described herein, with sufficient additional volume capacity to reduce possibility of water spillage during operation.

Chamber guide 13 comprises a substantially horizontal ring or annulus, substantially parallel to reservoir base 11, of sufficient outermost dimension for rigid attachment to an innermost surface of reservoir body 12 at a level to which a portion of an interior chamber of reservoir body 12 must be filled with water for hookah operation as described further herein, of sufficient innermost dimension to readily allow easy insertion, removal, and vertical motion of a demountably installable smoke and vapor collection chamber (FIG. 1), simultaneously limiting horizontal motion of a suitably installed smoke and vapor collection chamber.

Reservoir top 14 comprises a substantially horizontal circular ring or annulus substantially similar in outermost dimension to reservoir body 12, substantially parallel to base 11, located at an uppermost extent of reservoir body 12 and rigidly attached thereto in such manner as to form a substantially watertight seal, of sufficient innermost dimension to readily allow easy insertion, removal, and vertical motion of a demountably installable smoke and vapor collection chamber (FIG. 1), simultaneously limiting horizontal motion of a suitably installed smoke and vapor collection chamber. Reservoir top 13 provides an ability to reduce the possibility of water spillage and to guide vertical motion and limit horizontal motion of a suitably installed smoke and vapor collection chamber during operation.

FIG. 10 is a perspective view of a preferred embodiment of a complete hookah assembly, showing a preferred embodiment of a smoke collection chamber (FIG. 1) comprising a chamber body 1, a chamber top 2, a tubular hollow smoke and vapor exhaust stem 3 to an uppermost extent of which a flexible hose 9 is demountably attached, a head production ring 5, a grommet 6, and a tubular hollow stem 7 to an uppermost extent of which a demountable smoke and vapor production device 8 such as a bowl for containing a suitable quantity of tobacco is rigidly attached, suitably installed into a preferred embodiment of a water reservoir (FIG. 2), comprising a reservoir base 11, a reservoir body 12, a smoke and vapor collection chamber guide 13, and a reservoir top 14. Reservoir body 12, chamber guide 13, and reservoir top 14 have sufficient inner dimensions to readily allow easy insertion, removal, and vertical motion of a demountably installable smoke and vapor collection chamber (FIG. 1), simultaneously limiting horizontal motion of suitably installed a smoke and vapor collection chamber.

Figure 4:
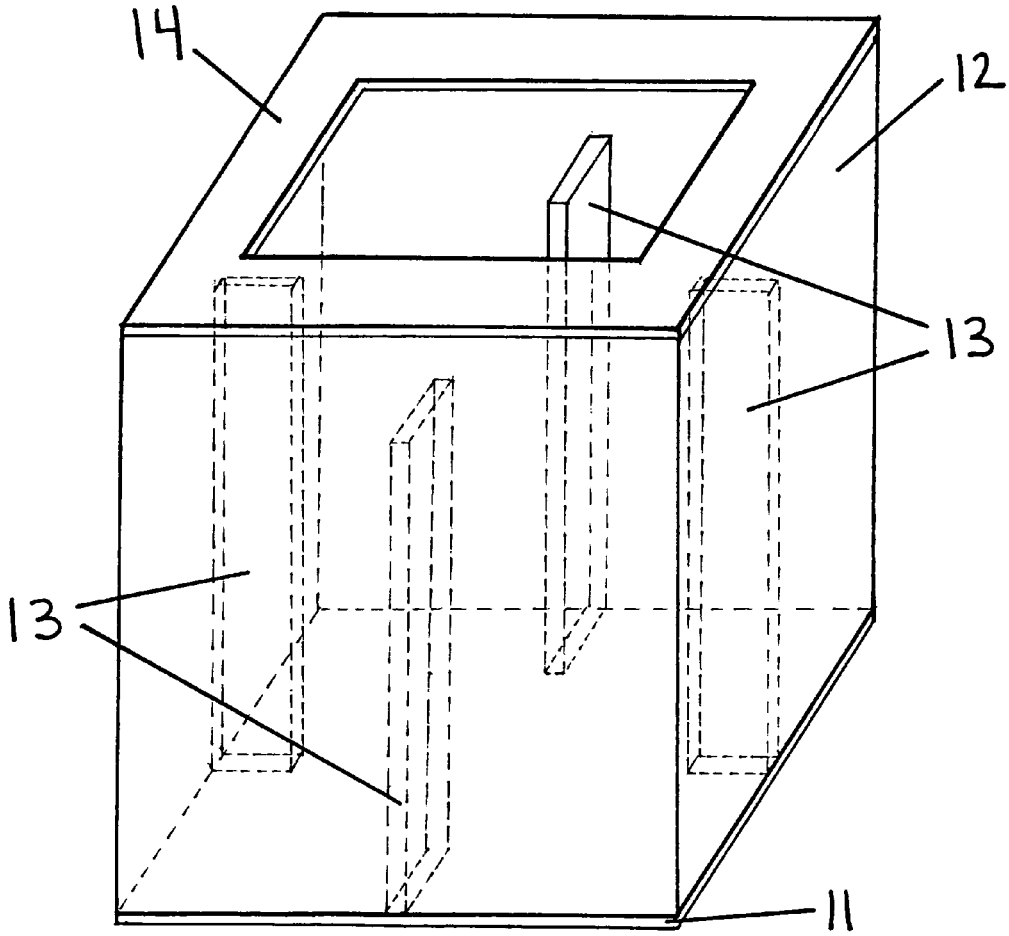
FIG. 4 shows a perspective view of an alternate embodiment of an improved hookah water reservoir.

FIGS. 2 and 4—Alternate Embodiment

An alternate embodiment of an improved tobacco hookah is illustrated by FIG. 2 and FIG. 4.

FIG. 2 is a perspective view of an alternate embodiment of a smoke and vapor collection chamber. Chamber body 1 in an alternate embodiment comprises a substantially upright cylinder of square cross-section, having an innermost and an outermost surface, in all other respects substantially similar to an embodiment shown in FIG. 1.

FIG. 4 is a perspective view of an alternate embodiment of a water reservoir, having alternate shapes for reservoir body 12 and reservoir base 11, and an alternate chamber guide 13.

Reservoir body 12 in an alternate embodiment comprises a substantially upright cylinder of square cross-section having an innermost and an outermost surface.

Reservoir base 11 comprises a substantially horizontal square planar member having an uppermost and a lowermost surface, substantially similar in outermost dimension to reservoir body 12, located at a lowermost extent of reservoir body 12 and having an uppermost surface rigidly attached thereto in such manner as to form a substantially watertight seal therewith.

Chamber guide 13 in an alternate embodiment comprises a plurality of inward projecting planer spacers, perpendicular to an interior surface of reservoir body 12 and rigidly attached thereto, rigidly attached and perpendicular to an interior surface of reservoir base 11, extending from an interior surface of reservoir base 11 upwards a distance corresponding to a level to which a portion of an interior chamber of reservoir body 12 must be filled with water for hookah operation.

Reservoir top 14 in an alternate embodiment comprises a substantially square planar annulus substantially similar in outermost dimension to reservoir body 12, located at an uppermost extent of reservoir body 12 and rigidly attached thereto, with sufficient inner dimension to readily allow easy insertion, removal, and vertical motion of a suitable smoke and vapor collection chamber.

In an alternate embodiment, reservoir body 12, chamber guide 13, and reservoir top 14 have sufficient inner dimensions to readily allow easy insertion, removal, and vertical motion of a demountably installable smoke and vapor collection chamber (FIG. 2), simultaneously limiting horizontal motion of a smoke and vapor collection chamber.

Operation—FIGS. 5 through 9 and FIG. 11.

Figure 5:
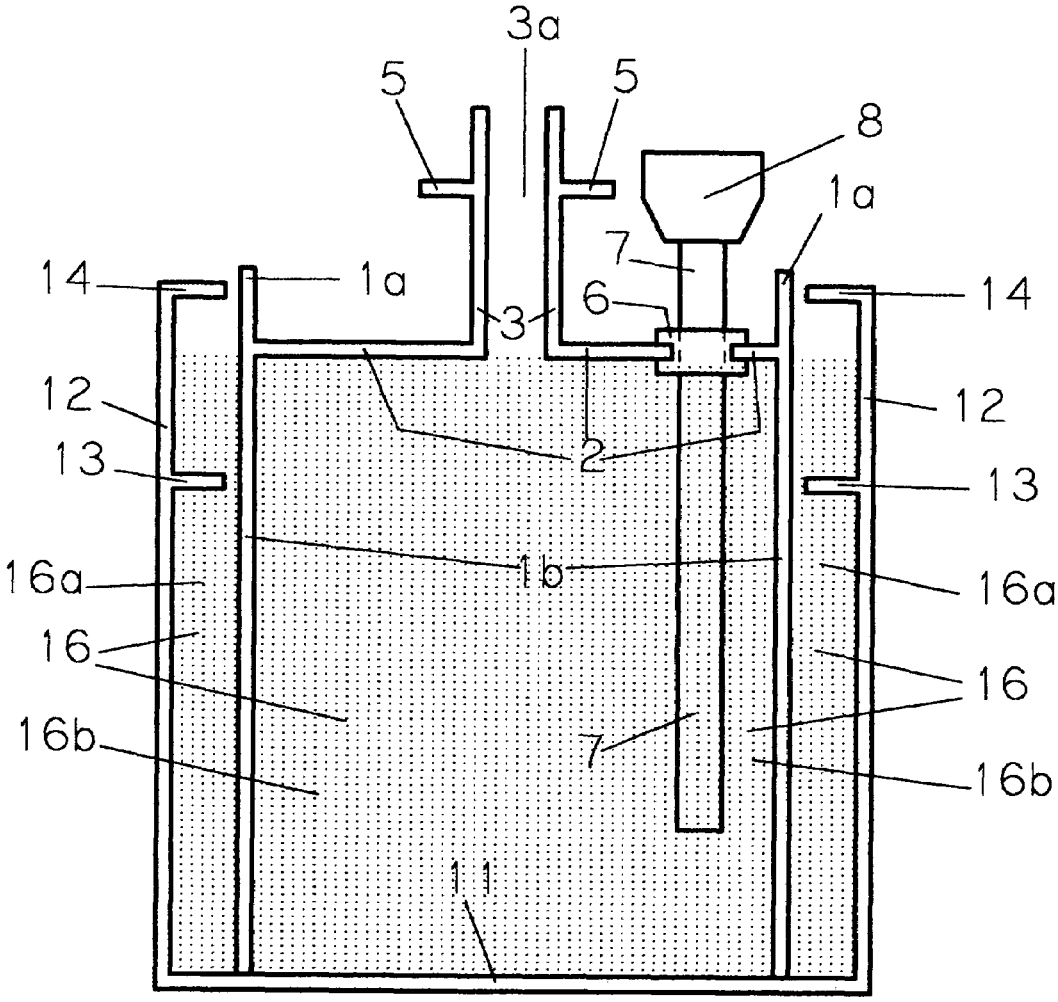
FIG. 5 is a longitudinal cross-section of a preferred embodiment showing a complete improved hookah assembly, filled with water, ready for operation.

FIG. 5 is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16 and ready for use. The smoke and vapor collection chamber being completely installed, interior portion of lower chamber body 1*b* substantially fills with water 16*b* as shown. Level of water 16*a* in reservoir body 12 matches level of water 16*b* in interior portion of lower chamber body 1*b*.

Figure 5A:
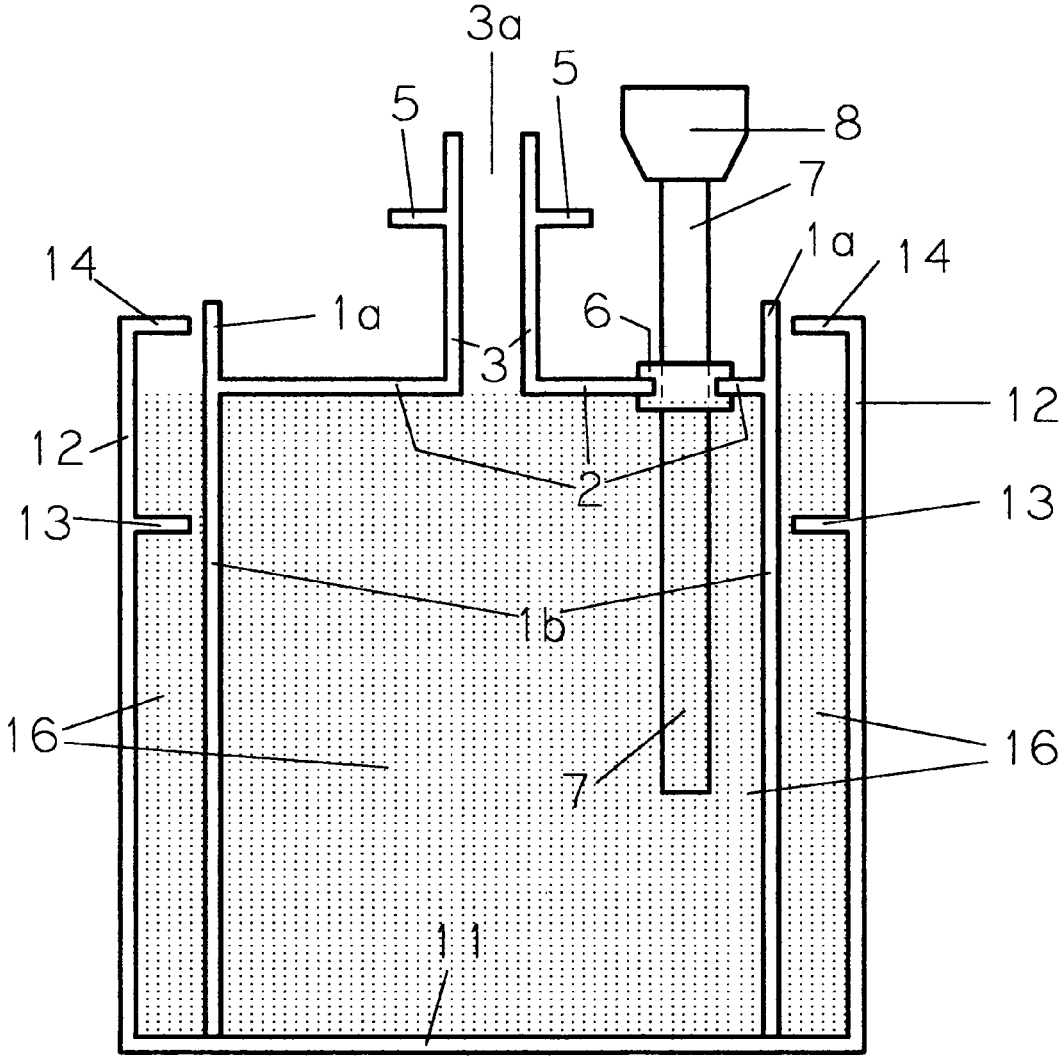

FIG. 5*a* is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, a tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16, similar to FIG. 5, differing only in an adjustment in vertical position made to a tubular hollow stem 7, illustrating a difference in smoke and vapor capacity selected by an operator as will be further described herein.

FIG. 6 is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, a tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16, in use, ready to draw smoke and vapor into an interior portion of lower chamber body 1*b*.

As described further herein, an operator having formed a substantially airtight seal of passage 3*a* and raised smoke and vapor collection chamber (FIG. 1) using head production ring 5 a suitable distance, a resulting difference between level of water 16*a* in water reservoir (FIG. 3) and level of water 16*b* in interior of lower chamber body 1*b* creates a hydraulic pressure gradient or head. Level of water 16*a* in reservoir body 12 being above lowermost extent of tubular hollow stem 7*a*, insufficient head exists to draw smoke and vapor into an interior portion of lower chamber body 1*b*.

FIG. 7 is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, a tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16, in use, drawing smoke and vapor 17 into interior portion of lower chamber body 1*b*.

As described further herein, an operator having formed a substantially airtight seal of passage 3*a* and raised smoke and vapor collection chamber (FIG. 1) using head production ring 5 sufficiently that level of water 16*a* in water reservoir (FIG. 3) falls below lowermost extent of tubular hollow stem 7*a*, sufficient head exists to draw smoke and vapor 17 into interior portion of lower chamber body 1*b*.

Drawn from smoke and vapor production device 8 down through tubular hollow stem 7, smoke and vapor 17 emerges from lowermost extent of tubular hollow stem 7*a* into water 16*b* contained in interior portion of lower chamber body 1*b*. Rising in the form of bubbles 17*a* up through filtering and cooling water 16*b* contained in interior portion of lower chamber body 1*b*, smoke and vapor 17 collects below chamber top 2 in interior portion of lower chamber body 1*b*. As smoke and vapor 17 collects inside interior portion of lower chamber body 1*b*, level of water 16*b* contained in interior portion of lower chamber body 1*b* drops, and level of water 16*a* in reservoir body 12 rises, resulting in a reduction of head.

FIG. 8 is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, a tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16, in use, ready to dispense smoke and vapor 17 collected in interior portion of lower chamber body 1*b*.

As described further herein, maintaining a substantially airtight seal of passage 3*a*, to eliminate any remaining head an operator using head production ring 5 has lowered smoke and vapor collection chamber (FIG. 1) sufficiently that level of water 16*a* in water reservoir (FIG. 3) substantially matches level of water 16*b* in interior portion of lower chamber body 1*b*. Level of water 16*b* in interior portion of lower chamber body 1*b* also serves in this improved hookah to automatically prevent loss of smoke and vapor 17 from interior portion of lower chamber body 1*b* through tubular hollow stem 7. An operator ensures lowermost extent of tubular hollow stem 7*a* remains submerged below level of water 16*b* in an interior portion of lower chamber body 1*b* during operation.

FIG. 9 is a longitudinal cross-section of a preferred embodiment along a plane parallel to an axis of exhaust stem 3 through the center of exhaust stem 3 showing a complete hookah assembly with a smoke and vapor collection chamber (FIG. 1) comprising an upper chamber body 1*a*, a lower chamber body 1*b*, a chamber top 2, an exhaust stem 3 with a passage 3*a*, a head production ring 5, a grommet 6, a tubular hollow stem 7, a smoke and vapor production device 8, and a flexible hose 9 (not shown) inserted into an uppermost extent of exhaust stem 3, demountably installed into a water reservoir (FIG. 3) comprising a reservoir base 11, a reservoir body 12, a chamber guide 13, and a reservoir top 14, filled with water 16, in use, dispensing smoke and vapor 17 collected in interior portion of lower chamber body 1*b*.

As described further herein, an operator, having released a substantially airtight seal of passage 3*a*, dispenses smoke and vapor 17 collected in interior portion of lower chamber body 1*b* through exhaust stem 3 via passage 3*a* into flexible hose 9 (not shown) by lowering smoke and vapor collection chamber (FIG. 1) into water reservoir (FIG. 3) using head production ring 5. As a smoke and vapor collection chamber is so lowered, level of water 16*b* in interior portion of lower chamber body 1*b* rises, flushing smoke and vapor 17 collected in interior portion of lower chamber body 1*b* through exhaust stem 3 via passage 3*a*, then through flexible hose 9 (not shown) for inhalation and enjoyment.

FIG. 11 is a perspective view of a preferred embodiment of a complete improved hookah assembly showing an operator demonstrating its use, as described further herein. An operator has established a substantially airtight seal of exhaust passage 3*a* by folding and kinking flexible hose 9 against topmost extent of exhaust stem 3 with a thumb, and lifted smoke collection chamber a suitable distance upwards relative to a water reservoir using fingers placed below a lowermost surface of head production ring 5 on either side of exhaust stem 3 such that a lowermost surface of chamber top 2 is above an uppermost surface of reservoir top 14 and a lowermost extent of chamber body 1 is between a lowermost extent of chamber guide ring 13 and an uppermost surface of reservoir base 11.

Operation—Method of Use

In operation of a preferred embodiment, an operator first fills water reservoir (FIG. 3) with a predetermined quantity of water sufficient to substantially fill an interior portion of a suitably installed smoke and vapor collection chamber. This predetermined quantity of water has a water level within a water reservoir substantially similar to an uppermost extent of chamber guide 13 prior to insertion and installation of smoke and vapor collection chamber. An operator rigidly attaches a suitable demountable smoke and vapor production device 8 such as a metallic tobacco bowl to an uppermost extent of tubular hollow stem 7, then lowers smoke and vapor collection chamber (FIG. 1) into a water reservoir (FIG. 3) and inserts a flexible hose 9 into an uppermost extent of exhaust stem 3 to form a complete hookah assembly as shown in FIG. 5 and FIG. 10, ready for use.

The unique design of this hookah separates the collection and dispensing of smoke and vapor into two distinct steps.

To collect smoke and vapor, an operator first sets a smoke and vapor capacity with a vertical adjustment to tubular hollow stem 7. Smoke and vapor capacity is a volume contained within interior portion of lower chamber body 1*b* determined by a distance between interior surface of chamber top 2 and lowermost extent of tubular hollow stem 7*a*. Upward vertical displacement in position of lowermost extent of tubular hollow stem 7*a* relative to an interior surface of chamber top 2 reduces smoke and vapor capacity, as shown in FIG. 5*a*. Downward vertical displacement in position of lowermost extent of tubular hollow stem 7*a* relative to an interior surface of chamber top 2 increases smoke and vapor capacity. Capacity graduation marks 15 placed at appropriate intervals on a surface of tubular hollow stem 7 allow convenient selection of a predetermined smoke and vapor capacity during operation. Having set a smoke and vapor capacity, an operator may repeatedly collect and dispense substantially similar quantities of smoke and vapor as described herein.

An operator then loads or fills the demountable smoke and vapor production device 8 rigidly attached to an uppermost extent of tubular hollow stem 7 with a suitable amount of tobacco and forms a substantially airtight seal of a passage 3*a* by folding and kinking flexible hose 9 against a topmost extent of exhaust stem 3 with a thumb, as shown in FIG. 11.

Using fingers placed beneath lowermost surface of head production ring 5 on either side of exhaust stem 3, maintaining a substantially airtight seal of passage 3*a* as described herein, an operator begins lifting smoke and vapor collection chamber (FIG. 1) upwards as shown in FIG. 11, simultaneously activating production of smoke and vapor in smoke and vapor production device 8, for example applying a lighted match or lighter to tobacco contained in a smoke and vapor production device 8 having the form of a metallic tobacco bowl. Due to substantially airtight seal of passage 3*a*, as smoke and vapor collection chamber (FIG. 1) is lifted, water 16*b* contained within interior portion of lower chamber body 1*b* is lifted as well, and level of water 16*a* in water reservoir (FIG. 3) drops. The resulting difference between level of water 16*a* in water reservoir (FIG. 3) and level of water 16*b* contained within interior portion of lower chamber body 1*b* produces a hydraulic pressure gradient, or head, as shown in FIG. 6.

Sufficient head to draw smoke and vapor from smoke and vapor production device 8 through tubular hollow stem 7, referred to as draw head, is attained when level of water 16*a* in water reservoir (FIG. 2) is below lowermost extent of tubular hollow stem 7*a*, as shown in FIG. 7. Maintaining a level of head greater than or equal to draw head as shown in FIG. 7 by maintaining a substantially airtight seal of passage 3*a* and lifting smoke and vapor collection chamber (FIG. 1) upwards using head production ring 5, an operator causes smoke and vapor 17 to be drawn from smoke and vapor production device 8 down through tubular hollow stem 7. Emerging from lowermost extent of tubular hollow stem 7*a* to be filtered and cooled by water 16*b* contained in interior portion of lower chamber body 1*b*, smoke and vapor 17 rises in the form of bubbles 17*a* and collects below chamber top 2 in interior portion of lower chamber body 1*b*.

The rate at which smoke and vapor is drawn into interior portion of lower chamber body 1*b* is dependent upon and varies with head. Increasing head by maintaining a substantially airtight seal of passage 3*a* and lifting smoke and vapor collection chamber (FIG. 1) upwards using head production ring 5, an operator increases draw rate. Conversely, decreasing head by maintaining a substantially airtight seal of passage 3*a* and lowering smoke and vapor collection chamber (FIG. 5) using head production ring 5, an operator decreases draw rate. In combination with a smoke and vapor production device 8 using combustion of tobacco, rate and temperature of combustion being dependent on draw rate, this feature allows an operator control over tobacco combustion rate and temperature.

As smoke and vapor is collected in interior portion of lower chamber body 1*b*, level of water 16*b* contained in interior portion of lower chamber body 1*b* drops, and level of water 16*a* in water reservoir rises, resulting in a reduction of head. An operator compensates for a reduction of head and maintains a level of head greater than or equal to draw head by maintaining a substantially airtight seal of passage 3*a* and continuing to lift smoke collection chamber upwards using head production ring 5 until a suitable quantity of smoke and vapor has been collected.

The quantity of smoke and vapor collected within interior portion of lower chamber body 1*b* is determined by the distance between interior surface of chamber top 2 and level of water 16*b* contained in interior portion of lower chamber body 1*b*. Volume graduation marks 10 appropriately placed on a surface of lower chamber body 1*b* allow an operator to measure a quantity of smoke and vapor collected during operation.

Level of water 16*b* in interior portion of lower chamber body 1*b* serves in this improved hookah to automatically prevent loss of smoke and vapor from interior portion of lower chamber body 1*b* through tubular hollow stem 7 when dispensing smoke. An operator ensures that lowermost extent of tubular hollow stem 7*a* remains submerged below level of water 16*b* in an interior portion of lower chamber body 1*b* during operation.

Having collected a suitable quantity of smoke and vapor, an operator may begin the dispensing of smoke and vapor.

To dispense smoke and vapor, an operator first eliminates any remaining head by maintaining a substantially airtight seal of passage 3*a* and lowering smoke and vapor collection chamber using head production ring 5 sufficiently that level of water 16*b* contained in interior portion of lower chamber body 1*b* substantially matches level of water 16*a* in water reservoir, as shown in FIG. 8.

Having eliminated any remaining head, an operator releases a substantially airtight seal of passage 3*a* by removing a thumb from flexible hose 9 folded and kinked against a topmost extent of exhaust stem 3 and unkinking flexible hose 9. An operator then dispenses smoke and vapor 17 as shown in FIG. 9 by lowering smoke and vapor collection chamber using head production ring 5 into water reservoir.

As smoke and vapor collection chamber is so lowered, level of water 16*b* contained in interior portion of lower chamber body 1*b* rises, flushing smoke and vapor 17 from interior portion of lower chamber body 1*b* through exhaust stem 3 via passage 3*a* and flexible hose 9 (not shown) for inhalation. Volume graduation marks 10 appropriately placed on a surface of lower chamber body 1*b* allow an operator to measure a suitable quantity of smoke and vapor dispensed during operation. The rate at which smoke and vapor is dispensed through flexible hose 9 can be varied by varying the rate at which smoke and vapor collection chamber (FIG. 1) is lowered into water reservoir (FIG. 3) when dispensing smoke and vapor.

CONCLUSION, RAMIFICATIONS, AND SCOPE

Thus the reader will see that in this improved hookah, water used to filter and cool smoke and vapor also serves to draw a quantity of smoke and vapor into a smoke and vapor collection chamber due to a hydraulic pressure gradient or head, relieving an operator of the necessity of personally creating a vacuum or negative pressure, and capable of attaining substantially greater vacuum or negative pressure than can be attained by ordinary inhalation. In addition this improved hookah permits an operator to control and vary the vacuum or negative pressure so created, so controlling the rate at which smoke and vapor is drawn into the improved hookah and collected, and thus the rate and temperature of tobacco combustion.

Following collection of a suitable quantity of smoke and vapor, water then serves to flush smoke and vapor from a smoke and vapor collection chamber through a flexible hose, dispensing smoke and vapor for inhalation, and relieving an operator of the necessity of personally creating a vacuum or negative pressure to inhale a desired quantity of smoke and vapor, while simultaneously preventing undesired egress of smoke and vapor.

This improved hookah may be used with any of a plurality of suitable demountably attached smoke and vapor production devices, measured quantities of smoke and vapor may be collected and dispensed, and the rate at which smoke and vapor is collected and dispensed can be controlled and varied by an operator.

Furthermore, in this improved hookah a predetermined quantity of smoke and vapor to be collected and dispensed may be set by an operator, and may be changed during operation. Having been set substantially similar quantities of smoke and vapor may be repeatably collected and dispensed during operation.

While the above description contains many specificities, these should not be construed as limitations on the scope of the invention, but rather as an exemplification of one preferred embodiment thereof. Many other variations are possible.

For example, rather than relying on traditional combustion for production of smoke and vapor an alternate embodiment may provide for use of any of a plurality of suitable demountable electrically operated smoke and vapor production devices.

Another alternate embodiment may provide a mechanical or electromechanical valve to establish, maintain, and release a substantially airtight seal of a smoke and vapor exhaust passage for the collection and dispensing of smoke and vapor as described herein. In such an embodiment the mechanism used to produce a hydraulic pressure gradient or head, and the mechanism providing an ability to set a smoke and vapor capacity may also be electromechanical rather than manual.

Accordingly, the scope of the invention should be determined not by the embodiments illustrated, but by the appended claims and their legal equivalents.

Accordingly, I claim:

1. An improved water pipe comprising (A) a smoke and vapor collection chamber comprising (a) a substantially upright substantially cylindrical chamber body in any of a plurality of cross-sections, said chamber body having an innermost and an outermost surface, said chamber body open at a lowermost extent in such manner as to readily allow entry and egress of a quantity of water;

(b) a substantially horizontal chamber top having an uppermost and a lowermost surface, said chamber top so dimensioned as to extend substantially across said chamber body and rigidly attached thereto at an uppermost extent thereof in such manner as to form a substantially airtight seal therewith, said chamber top comprising (i) a passage extending from said uppermost surface to said lowermost surface so dimensioned as to allow a quantity of smoke and vapor to flow readily therethrough;

(ii) a hole penetrating from said uppermost surface to said lowermost surface, said hole so positioned as to be between an outermost extent of said passage and said innermost surface of said chamber body;

(iii) a portion of an interior of said chamber body within said innermost surface of said chamber body extending from said lowermost surface of said chamber top to said lowermost extent of said chamber body forming a chamber suitable for the collection and dispensing of a quantity of smoke and vapor;

said passage and said hole opening from said lowermost surface of said chamber top into said chamber suitable for the collection and dispensing of a quantity of smoke and vapor;

(c) a first means providing an ability to measure a portion of a quantity of smoke and vapor contained within said chamber suitable for the collection and dispensing of a quantity of smoke and vapor;

(d) a tubular hollow stem member demountably inserted through said hole and forming a substantially airtight seal therewith, extending for a portion of its length above said uppermost surface of said chamber top and extending for a portion of its length below said lowermost surface of said chamber top into a portion of an interior of said chamber suitable for the collection and dispensing of a quantity of smoke and vapor, said tubular hollow stem member so dimensioned and positioned as to have a lowermost extent thereof between said lowermost surface of said chamber top and said lowermost extent of said chamber body;

(e) a demountable second means providing an ability to contain a suitable quantity of tobacco and to produce a quantity of smoke and vapor therefrom, rigidly attached to an uppermost extent of said tubular hollow stem member in such manner as to readily allow a flow of a portion of said quantity of smoke and vapor from said second means through said tubular hollow stem member, whereby any of a plurality of such suitable second means may be used by an operator for the production of a suitable quantity of smoke and vapor;

(f) a third means providing an ability to alter and adjust a relative vertical positioning of said lowermost extent of said tubular hollow stem member and said lowermost surface of said chamber top, whereby a predetermined quantity of smoke and vapor to be collected may be set by an operator;

(g) a fourth means providing an ability to establish, maintain, and release a substantially airtight seal of said passage and said chamber suitable for the collection and dispensing of a quantity of smoke and vapor, whereby an operator may establish and maintain said substantially airtight seal of said passage and said chamber suitable for the collection and dispensing of a quantity of smoke and vapor to collect within an interior portion thereof a suitable quantity of smoke and vapor and whereby an operator may release said substantially airtight seal for dispensing a portion of said quantity of smoke and vapor from a portion of an interior of said chamber suitable for the collection and dispensing of a quantity of smoke and vapor through said passage for inhalation and enjoyment;

(B) a water reservoir comprising (a) a substantially upright substantially cylindrical reservoir body in any of a plurality of cross-sections, said reservoir body having an innermost and an outermost surface, said reservoir body open at an uppermost extent thereof and so dimensioned as to readily allow installation, removal, and vertical motion of said smoke and vapor collection chamber;

(b) a substantially horizontal reservoir base having an uppermost and a lowermost surface, said reservoir base so dimensioned as to substantially extend across said reservoir body and rigidly attached to a lowermost extent thereof in such a manner as to form a substantially watertight seal therewith;

(c) a portion of an interior within said innermost surface of said reservoir body extending from said uppermost surface of said reservoir base to said uppermost extent of said reservoir body forming a chamber within an interior portion thereof may be contained a quantity of water sufficient to substantially fill an interior portion of said smoke and vapor collection chamber when said smoke and vapor collection chamber is suitably installed into said water reservoir;

(C) a fifth means providing an ability to alter and adjust a relative vertical positioning of said water reservoir and said smoke and vapor collection chamber, said smoke and vapor collection chamber being suitably installed into said water reservoir, whereby said water reservoir being filled with a suitable quantity of water, said suitable quantity of water being sufficient to substantially fill an interior portion of said smoke and vapor collection chamber so suitably installed, said fourth means having established a substantially airtight seal of said passage and said chamber suitable for the collection and dispensing of a quantity of smoke and vapor, said fifth means will by raising said smoke and vapor collection chamber relative to said water reservoir produce a hydraulic pressure gradient, also known as head, sufficient to cause a quantity of smoke and vapor to be drawn from said second means through said tubular hollow stem member into a portion of an interior of said chamber suitable for the collection and dispensing of a quantity of smoke and vapor, and whereby said quantity of smoke and vapor will be filtered and cooled by passing through a quantity of water contained within an interior portion of said chamber suitable for the collection and dispensing of a quantity of smoke and vapor, and whereby said quantity of water within an interior portion of said chamber suitable for the collection and dispensing of a quantity of smoke and vapor serves both to draw a quantity of smoke and vapor from said second means through said tubular hollow stem member into an interior portion of said chamber suitable for the collection and dispensing of a quantity of smoke and vapor due to said hydraulic pressure gradient, and to filter and cool said quantity of smoke and vapor, and whereby an operator may adjust a relative vertical positioning of said smoke and vapor collection chamber and said water reservoir so as to control and vary said hydraulic pressure gradient, so controlling and varying a rate at which smoke and vapor may be drawn from said second means through said tubular hollow stem member into said chamber suitable for the collection and dispensing of a quantity of smoke and vapor, so also controlling a rate and temperature of combustion within said second means, and whereby an operator may adjust a relative vertical positioning of said smoke and vapor collection chamber and said water reservoir so as to ensure that a lowermost extent of said tubular hollow stem member remains always immersed below a surface of a portion of a quantity of water contained within an interior portion of said chamber suitable for the collection and dispensing of a quantity of smoke and vapor during operation, and whereby said fourth means having released a substantially airtight seal of said passage and said chamber suitable for the collection and dispensing of a quantity of smoke and vapor, said lowermost extent of said tubular hollow stem member remaining always immersed below a surface of said quantity of water contained within an interior portion of said chamber suitable for the collection and dispensing of a quantity of smoke and vapor, said fifth means by lowering said smoke and vapor collection chamber relative to said water reservoir allows a portion of said quantity of smoke in a portion of an interior of said chamber suitable for the collection and dispensing of a quantity of smoke and vapor to be flushed through said passage for inhalation and enjoyment, simultaneously preventing an undesired outflow of said portion of said quantity of smoke an vapor through said tubular hollow stem member and said second means.

2. An improved hookah comprising the improved water pipe of claim 1 wherein a flexible hose of sufficient interior dimension to readily allow a flow of smoke and vapor therethrough, substantially similar in outermost dimension to an outermost extent of said passage, may be demountably inserted into said passage in such manner as to form a substantially airtight seal therewith, whereby a quantity of smoke and vapor may be comfortably and conveniently inhaled and enjoyed.

3. The improved water pipe of claim 1 wherein said chamber top is so positioned as to have an uppermost surface of said chamber top below an uppermost extent of said chamber body, said chamber top so dimensioned as to substantially extend across an innermost surface of said chamber body and rigidly attached thereto in such manner as to form a substantially airtight seal therewith, having a portion of said chamber body extending downwards from said lower surface of said chamber top for a suitable distance and having a portion of said chamber body extending upwards from an uppermost surface of said chamber top for a suitable distance, whereby spilling of water onto said upper surface of said chamber top may be prevented during operation.

4. An improved hookah comprising the improved water pipe of claim 3 wherein a flexible hose of sufficient interior dimension to readily allow a flow of smoke and vapor therethrough, substantially similar in outermost dimension to an outermost extent of said passage, may be demountably inserted into said passage in such manner as to form a substantially airtight seal therewith, whereby spilling of water onto said upper surface of said chamber top may be prevented during operation, and whereby a quantity of smoke and vapor may be comfortably and conveniently inhaled and enjoyed.

5. The improved water pipe of claim 3, wherein said water reservoir comprises in addition a substantially horizontal substantially planar annular reservoir top having an uppermost and a lowermost surface, substantially similar in outermost dimension to said reservoir body, substantially parallel to said reservoir base, located at an uppermost extent of said reservoir body and rigidly attached thereto in such manner as to form a substantially watertight seal therewith, substantially similar in innermost dimension to an outermost dimension of said smoke and vapor collection chamber, of sufficient innermost dimension to readily allow easy installation, removal, and vertical motion of said smoke and vapor collection chamber, simultaneously limiting horizontal motion of said smoke and vapor collection chamber when so suitably installed therewithin, whereby spilling of water onto said upper surface of said chamber top may be prevented during operation, and whereby spilling of water from said water reservoir onto a surface upon which said water pipe is placed may be prevented.

6. An improved hookah comprising the improved water pipe of claim 5, wherein a flexible hose of sufficient interior dimension to readily allow a flow of smoke and vapor therethrough, substantially similar in outermost dimension to an outermost extent of said passage, may be demountably inserted into said passage in such manner as to form a substantially airtight seal therewith, whereby spilling of water onto said upper surface of said chamber top may be prevented during operation, and whereby spilling of water from said water reservoir onto a surface upon which said water pipe is placed may be prevented, and whereby a quantity of smoke and vapor may be comfortably and conveniently inhaled and enjoyed.

7. An improved water pipe comprising (A) a smoke and vapor collection chamber comprising (a) a substantially upright substantially cylindrical chamber body in any of a plurality of cross-sections, said chamber body having an innermost and an outermost surface, said chamber body open at a lowermost extent in such manner as to readily allow entry and egress of a quantity of water;

(b) a substantially horizontal chamber top having an uppermost and a lowermost surface, said chamber top so dimensioned as to extend substantially across said chamber body and rigidly attached thereto at an uppermost extent thereof in such manner as to form a substantially airtight seal therewith, said chamber top comprising (i) a first tubular hollow stem member having an innermost and an outermost surface, substantially perpendicular to said uppermost surface of said chamber top, having a lowermost extent thereof rigidly attached thereto in such manner as to form a substantially airtight seal therewith, so dimensioned at an uppermost extent thereof as to allow an operator to establish a substantially airtight seal therewith using a thumb;

(ii) a portion of an interior within said innermost surface of said first tubular hollow stem member forming a passage so dimensioned as to allow a quantity of smoke and vapor to flow readily therethrough, said passage extending from said uppermost extent of said first tubular hollow stem member through said lowermost extent of said first tubular hollow stem member, said uppermost surface of said chamber top, and said lowermost surface of said chamber top;

(iii) a substantially horizontal planar annulus having an uppermost and a lowermost surface, substantially similar in innermost dimension to said outermost surface of surface of said first tubular hollow stem member and rigidly attached thereto, a portion of a length of said first tubular hollow stem member extending upwards from said uppermost surface of said horizontal planar annulus, a portion of a length of said first tubular hollow stem member extending downwards from said lowermost surface of said horizontal planar annulus, said horizontal planar annulus of sufficient outer dimension as to allow an operator a secure grip with fingers placed below said lowermost surface thereof, said horizontal planar annulus so positioned as to allow an operator to form said substantially airtight seal of said uppermost extent of said first tubular hollow stem member using a thumb with fingers so placed below said lowermost surface thereof, whereby an operator may establish, maintain, and release a substantially airtight seal of said passage, and whereby an operator may alter and adjust a vertical positioning of a smoke and vapor collection chamber during operation;

(iv) a hole penetrating from said uppermost surface of said chamber top to said lowermost surface of said chamber top, said hole so positioned as to be between said outermost surface of said first tubular hollow stem member and said innermost surface of said chamber body;

(v) a portion of an interior of said chamber body within said innermost surface of said chamber body extending from said lowermost surface of said chamber top to said lowermost extent of said chamber body forming a chamber suitable for the collection and dispensing of a quantity of smoke and vapor;

said passage and said hole opening from said lowermost surface of said chamber top into said chamber suitable for the collection and dispensing of a quantity of smoke and vapor;

(c) a first means providing an ability to measure a portion of a quantity of smoke and vapor contained within said chamber suitable for the collection and dispensing of a quantity of smoke and vapor;

(d) a second tubular hollow stem member demountably inserted through said hole and forming a substantially airtight seal therewith, extending for a portion of its length above said uppermost surface of said chamber top and extending for a portion of its length below said lowermost surface of said chamber top into a portion of an interior of said chamber suitable for the collection and dispensing of a quantity of smoke and vapor, said second tubular hollow stem member so dimensioned and positioned as to have a lowermost extent thereof between said lowermost surface of said chamber top and said lowermost extent of said chamber body;

(e) a demountable second means providing an ability to contain a suitable quantity of tobacco and to produce a quantity of smoke and vapor therefrom, rigidly attached to an uppermost extent of said second tubular hollow stem member in such manner as to readily allow a flow of a portion of said quantity of smoke and vapor from said and vapor through said passage for inhalation and enjoyment;

(B) a water reservoir comprising (a) a substantially upright substantially cylindrical reservoir body in any of a plurality of cross-sections, said reservoir body having an innermost and an outermost surface, said reservoir body open at an uppermost extent thereof and so dimensioned as to readily allow installation, removal, and vertical motion of said smoke and vapor collection chamber;

(b) a substantially horizontal reservoir base having an uppermost and a lowermost surface, said reservoir base so dimensioned as to substantially extend across said reservoir body and rigidly attached to a lowermost extent thereof in such a manner as to form a substantially watertight seal therewith;

(c) a portion of an interior within said innermost surface of said reservoir body extending from said uppermost surface of said reservoir base to said uppermost extent of said reservoir body forming a chamber within an interior portion thereof may be contained a quantity of water sufficient to substantially fill an interior portion of said smoke and vapor collection chamber when said smoke and vapor collection chamber is suitably installed into said water reservoir;

(d) a substantially horizontal substantially planar annular reservoir top having an uppermost and a lowermost surface, substantially similar in outermost dimension to said reservoir body, substantially parallel second means through said second tubular hollow stem member, whereby any of a plurality of such suitable second means may be used by an operator for the production of a suitable quantity of smoke and vapor;

(f) a third means providing an ability to alter and adjust a relative vertical positioning of said lowermost extent of said second tubular hollow stem member and said lowermost surface of said chamber top, whereby a predetermined quantity of smoke and vapor to be collected may be set by an operator;

(g) a fourth means providing an ability to establish, maintain, and release a substantially airtight seal of said first tubular hollow stem member, said passage, and said chamber suitable for the collection and dispensing of a quantity of smoke and vapor, whereby an operator may establish and maintain said substantially airtight seal of said first tubular hollow stem member, said passage, and said chamber suitable for the collection and dispensing of a quantity of smoke and vapor to collect within an interior portion thereof a suitable quantity of smoke and vapor and whereby an operator may release said substantially airtight seal of said first tubular hollow stem member, said passage, and said chamber suitable for the collection and dispensing of a quantity of smoke and vapor to dispense a portion of said quantity of smoke and vapor so collected from a portion of an interior of said chamber suitable for the collection and dispensing of a quantity of smoke to said reservoir base, located at an uppermost extent of said reservoir body and rigidly attached thereto in such manner as to form a substantially watertight seal therewith, substantially similar in innermost dimension to an outermost dimension of said smoke and vapor collection chamber, of sufficient innermost dimension to readily allow easy installation, removal, and vertical motion of said smoke and vapor collection chamber, simultaneously limiting horizontal motion of said smoke and vapor collection chamber when so suitably installed therewithin, whereby spilling of water from said water reservoir onto a surface upon which said water pipe is placed may be prevented;

(C) a fifth means providing an ability to alter and adjust a relative vertical positioning of said water reservoir and said smoke and vapor collection chamber, said smoke and vapor collection chamber being suitably installed into said water reservoir, whereby said water reservoir being filled with a suitable quantity of water, said suitable quantity of water being sufficient to substantially fill an interior portion of said smoke and vapor collection chamber so suitably installed, said fourth means having established a substantially airtight seal of said first tubular hollow stem member, said passage, and said chamber suitable for the collection and dispensing of a quantity of smoke and vapor, said fifth means will by raising said smoke and vapor collection chamber relative to said water reservoir produce a hydraulic pressure gradient, also known as head, sufficient to cause a quantity of smoke and vapor to be drawn from said second means through said second tubular hollow stem member into a portion of an interior of said chamber suitable for the collection and dispensing of a quantity of smoke and vapor, and whereby said quantity of smoke and vapor will be filtered and cooled by passing through a quantity of water contained within an interior portion of said chamber suitable for the collection and dispensing of a quantity of smoke and vapor, and whereby said quantity of water within an interior portion of said chamber suitable for the collection and dispensing of a quantity of smoke and vapor serves both to draw a quantity of smoke and vapor from said second means through said second tubular hollow stem member into an interior portion of said chamber suitable for the collection and dispensing of a quantity of smoke and vapor due to said hydraulic pressure gradient, and to filter and cool said quantity of smoke and vapor, and whereby an operator may adjust a relative vertical positioning of said smoke and vapor collection chamber and said water reservoir so as to control and vary said hydraulic pressure gradient, so controlling and varying a rate at which smoke and vapor may be drawn from said second means through said second tubular hollow stem member into said chamber suitable for the collection and dispensing of a quantity of smoke and vapor, so also controlling a rate and temperature of combustion within said second means, and whereby an operator may adjust a relative vertical positioning of said smoke and vapor collection chamber and said water reservoir so as to ensure that a lowermost extent of said second tubular hollow stem member remains always immersed below a surface of a portion of a quantity of water contained within an interior portion of said chamber suitable for the collection and dispensing of a quantity of smoke and vapor during operation, and whereby said fourth means having released a substantially airtight seal of said first tubular hollow stem member, said passage, and said chamber suitable for the collection and dispensing of a quantity of smoke and vapor, said lowermost extent of said second tubular hollow stem member remaining always immersed below a surface of said quantity of water contained within an interior portion of said chamber suitable for the collection and dispensing of a quantity of smoke and vapor, said fifth means by lowering said smoke and vapor collection chamber relative to said water reservoir allows a portion of said quantity of smoke in a portion of an interior of said chamber suitable for the collection and dispensing of a quantity of smoke and vapor to be flushed through said passage for inhalation and enjoyment, simultaneously preventing an undesired outflow of said portion of said quantity of smoke an vapor through said second tubular hollow stem member and said second means.

8. An improved hookah comprising the improved water pipe of claim 7 wherein a flexible hose of sufficient interior dimension to readily allow a flow of smoke and vapor therethrough, substantially similar in outermost dimension to said innermost surface of said first tubular hollow stem member, may be demountably inserted into said uppermost extent of said first tubular hollow stem member in such manner as to form a substantially airtight seal therewith, whereby a quantity of smoke and vapor may be comfortably and conveniently inhaled and enjoyed.

9. The improved water pipe of claim 7 wherein said chamber top is so positioned as to have an uppermost surface of said chamber top below an uppermost extent of said chamber body, said chamber top so dimensioned as to substantially extend across an innermost surface of said chamber body and rigidly attached thereto in such manner as to form a substantially airtight seal therewith, having a portion of said chamber body extending downwards from said lower surface of said chamber top for a suitable distance and having a portion of said chamber body extending upwards from an uppermost surface of said chamber top for a suitable distance, whereby spilling of water onto said upper surface of said chamber top may be prevented during operation.

10. An improved hookah comprising the improved water pipe of claim 9 wherein flexible hose of sufficient interior dimension to readily allow a flow of smoke and vapor therethrough, substantially similar in outermost dimension to said innermost surface of said first tubular hollow stem member, may be demountably inserted into said uppermost extent of said first tubular hollow stem member in such manner as to form a substantially airtight seal therewith, whereby spilling of water onto said upper surface of said chamber top may be prevented during operation, and whereby a quantity of smoke and vapor may be comfortably and conveniently inhaled and enjoyed.

* * * * *